US007189127B2

(12) United States Patent
Otobe et al.

(10) Patent No.: US 7,189,127 B2
(45) Date of Patent: Mar. 13, 2007

(54) WATERCRAFT PROPULSION MACHINE

(75) Inventors: Taiichi Otobe, Wako (JP); Toyokazu Kawasaki, Wako (JP); Haruhiko Ohkawa, Wako (JP)

(73) Assignee: Honda Motor Co., Ltd. (JP)

( * ) Notice: Subject to any disclaimer, the term of this patent is extended or adjusted under 35 U.S.C. 154(b) by 0 days.

(21) Appl. No.: 11/092,805

(22) Filed: Mar. 29, 2005

(65) Prior Publication Data

US 2005/0221695 A1 Oct. 6, 2005

(30) Foreign Application Priority Data

Mar. 30, 2004 (JP) ..... 2004-101524
Mar. 30, 2004 (JP) ..... 2004-101546

(51) Int. Cl.
*B63H 5/20* (2006.01)

(52) U.S. Cl. ..... 440/53

(58) Field of Classification Search ..... 440/53
See application file for complete search history.

(56) References Cited

U.S. PATENT DOCUMENTS 1,738,979 A * 12/1929 Adelmann et al. ..... 440/53
2,840,832 A * 7/1958 Fried ..... 114/55.54
3,294,055 A 12/1966 McGuire ..... 115/70
3,918,666 A 11/1975 Florian ..... 248/4
5,599,216 A * 2/1997 Reightley ..... 440/53
RE35,906 E * 9/1998 Sanders ..... 43/6.5
6,799,528 B1 * 10/2004 Bekker ..... 114/151

FOREIGN PATENT DOCUMENTS

JP 0195499 6/1989
JP 04071989 3/1992

* cited by examiner

*Primary Examiner*—Stephen Avila
(74) *Attorney, Agent, or Firm*—Adams & Wilks

(57) ABSTRACT

A watercraft propulsion machine equipped with an outboard motor is provided. The propulsion machine includes a propulsion machine body and the outboard motor. The propulsion machine body is detachably mountable to a hull. The outboard motor is mounted on a rotary shaft provided at the rear of the propulsion machine body and oriented longitudinally of the propulsion machine body. The outboard motor is fixedly mounted on the rotary shaft which is rotatably mounted to the propulsion machine body, and is swingable relative to the propulsion machine body.

8 Claims, 22 Drawing Sheets

WATERCRAFT PROPULSION MACHINE

FIELD OF THE INVENTION

The present invention relates to a watercraft propulsion machine provided with a propulsion unit, which is designed to be detachably mounted to a hull of a watercraft such as a surfboard, a windsurfing board and a canoe.

BACKGROUND OF THE INVENTION

A small watercraft such as a canoe equipped with an outboard motor is disclosed in U.S. Pat. No. 3,918,666, for example. This craft is a canoe to which an outboard motor is detachably mounted to provide propulsive power.

An auxiliary buoyant unit with floats provided to a small watercraft for adding buoyancy to the small watercraft is disclosed in U.S. Pat. No. 3,294,055, for example. This small watercraft has a structure in which the floats (auxiliary buoyant bodies) are extended to the right and left of a hull to which a propulsion unit is fixedly provided, and the right and left floats are attached to opposite ends of an arm pivotally mounted to the hull. The auxiliary buoyant bodies provided to the small watercraft are fixedly attached to the hull, and the maneuverability of the hull as a whole is fixed. Therefore, it is impossible to choose between maneuvering of the hull without the propulsion unit and maneuvering of the hull with the propulsion unit.

A very small watercraft for play or sport such as a surfboard is not usually provided with a propulsion unit, and is manipulated by riding on the crest of wave in a standing position utilizing an elemental force (force of a wave). A surfboard fixedly provided with a propulsion unit is disclosed in Japanese Utility Model Laid-Open Publication No. HEI-1-95499, for example. This surfboard is configured to be propelled by a jet-pump-type screw or impeller provided in a rear portion of the surfboard and driven by an engine horizontally provided in the surfboard.

With this art, however, since the engine and the screw are provided in the plate-shaped surfboard, the surfboard as a whole is increased in size and weight. The surfboard is thus only used as a craft propelled by a propulsion machine, and cannot be used for the sport of surfing, a watercraft sport with agility for which a surfboard is intended. The surfboard with the propulsion unit is very expensive for a surfboard.

Another surfboard fixedly provided with a jet-pump-type propulsion unit is disclosed in Japanese Patent Laid-Open Publication No. HEI-4-71989, for example.

This jet-pump-type surfboard includes a nozzle of a jet pump fixedly provided at the rear of the surfboard, which is a laterally movable steering nozzle. The nozzle is rotated for steering by operating a hydraulic cylinder. In this art, a plumb bob detects a positional change of the surfboard; a switching valve is operated by a pilot pressure from a pilot valve; and the hydraulic cylinder is operated utilizing the water pressure of a jet pump slipstream to rotate the steering nozzle, thereby to steer the surfboard.

However, since this surfboard also has the propulsion unit integrally provided in the board, the board as a whole is increased in size and weight. The surfboard is thus only used as a watercraft propelled by the propulsion unit, and cannot be used for the sport of surfing, a watercraft sport with agility for which a surfboard is intended. In addition, this surfboard is also a surfboard with a propulsion unit, and is very expensive for a surfboard.

The above-described small watercraft to which the outboard motor is detachably mounted, disclosed in U.S. Pat. No. 3,918,666 is a canoe steered in a seated position, to which the outboard motor is detachably mounted. A canoe is rowed manually with a paddle. In the art disclosed in this patent, however, the outboard motor is detachably mounted to the rear of the canoe which is propelled by the outboard motor when necessary. The outboard motor is swung right and left by a steering bar for manual steering. That is, the canoe has great buoyancy, and is steered by turning operation of the outboard motor.

The above-described surfboards disclosed in Japanese Utility Model Laid-Open Publication No. HEI-1-95499 and Japanese Patent Laid-Open Publication No. HEI-4-71989 each include the propulsion unit provided in the board. The surfboard of HEI-1-95499 does not include a steering means. The surfboard disclosed in HEI-4-71989 includes the steering nozzle of the integral propulsion unit, which is rotated to change the direction of jets. The canoe of U.S. Pat. No. 3,918,666 is, in short, steered in a similar manner as an outboard motor.

That is, if an operator operates the surfboard with the propulsion unit mounted, by hand-operating the steering bar from a predetermined position, the operator is occupied by a steering feel as felt in a conventional outboard motor. As a result, dynamic pleasure produced from riding the flat-bottomed surfboard of short or little draft dies away.

For this reason, demand exists for an art which allows an operator or rider, when steer-controlling the direction of propulsion by a propulsion unit, to turn the propulsion unit in line with tilting actions by waves of a hull, by shifting his weight sideways, keeping a balance between buoyancy and gravity, to steering the hull, without hand-operating a steering bar.

SUMMARY OF THE INVENTION

According to the present invention, there is provided a propulsion machine detachably mountable to a watercraft, which comprises: a propulsion machine body detachably mountable to the watercraft via a mounting mechanism; and a propulsion unit swingably connected to the propulsion machine body via a shaft oriented longitudinally of the propulsion machine body.

The propulsion unit is thus connected to the propulsion machine body swingably to the right and left side. Although a hull is changed in its weight balance when mounted with the propulsion machine, the propulsion unit of the propulsion machine is swingable relative to the hull, and thus does not greatly reduce maneuverability an operator feels through the hull. Accordingly, a watercraft propulsion machine with good maneuverability can be obtained.

In the present invention, since the propulsion machine is detachably mounted to a hull floating body) for sport such as a surfboard, it becomes possible to easily travel to a nearby place by the propulsion unit, for example, as well as playing in a conventional way with a surfboard or the like, resulting in an advantage of increased variations in the way of playing with a surfboard or the like.

Also, since the propulsion machine can be separated and disassembled from a small watercraft such as a surfboard or a boat, there is an advantage that transportation of the propulsion machine is facilitated.

The propulsion machine in the present invention preferably further comprises a pair of right and left auxiliary buoyant bodies, the auxiliary buoyant bodies being swingably connected to the propulsion machine body via the shaft oriented longitudinally of the body. The auxiliary buoyant bodies thus reduce effects on a change of maneuverability an operator feels through the hull. That is, the auxiliary buoyant bodies providing buoyancy to the entire hull without greatly reducing the maneuverability of the hull on which an operator rides, can be obtained. Since the auxiliary buoyant bodies are mounted to the propulsion machine body, shifts of the center of gravity can be adjusted to an operator's preference. The hull not greatly reduced in maneuverability can be swung sideways when being propelled for play such as shifting the center of gravity.

Further, according to the present invention, there is provided a propulsion machine detachably mountable to a watercraft, which comprises: a propulsion machine body detachably mountable to the watercraft via a mounting mechanism; a propulsion unit swingably connected to the propulsion machine body via a horizontal shaft oriented longitudinally of the propulsion machine body, the propulsion unit being provided in a steerable manner on a vertical shaft; a mounting portion mounted on the longitudinally-oriented horizontal shaft, to which the propulsion unit is mounted; and a conversion mechanism for converting rotation about the longitudinally-oriented horizontal shaft into rotation about the vertical shaft when the watercraft tilts sideways, so that the propulsion unit is moved for steering with the tilting.

With this propulsion machine, sideways tilting of the hull by an operator's (player's) shifting his weight causes the mounting portion to swing via the conversion mechanism, and the propulsion unit mounted thereto also swings. With tilting of the hull, the propulsion unit is turned for steering. In this manner, an operator riding on the hull can tilt the hull by shifting his weight sideways, thereby steering the hull in that direction. A rider can shift his weight sideways for steering as he does in surfing. Thus, with the hull mounted with the propulsion unit and propelled by propulsive force, a rider can enjoy steering by weight shift as he does with a surfboard or the like.

Since the hull is steered via the conversion mechanism provided at the rear of the propulsion machine body, in relation to a weight shift on a hull or the like, an operator does not need to constantly grip a steering bar, and can steer through sportive manipulation by weight shift.

The propulsion machine is configured simply with the mounting portion pivotally supported by the propulsion machine body to be swingable, and with the conversion mechanism interposed between the propulsion unit and the propulsion machine body. The propulsion machine, which is detachably mounted to a surfboard, has advantages that it allows travel to a nearby place by the propulsion unit and play on the water without making changes to a conventional surfboard or a floating body. Also, the propulsion machine can be removed for doing surfing or other play on the water by human power in a conventional way.

Since the propulsion machine can be desirably separated and disassembled from a small watercraft such as a surfboard or a boat, there is an advantage that transportation of the propulsion machine is facilitated.

The conversion mechanism preferably comprises a first bracket fixed at the propulsion machine body side, and a swingable steering link pivotally supported at a middle portion thereof on the mounting portion. An upper portion of the steering link is connected to a steering rod protruded forward from the propulsion unit in such a manner as to restrict a relative displacement in a swinging direction of the steering link and allow a relative displacement in a longitudinal direction of the steering link. The first bracket and a portion below the pivotally supported portion of the steering link are swingably connected. In an embodiment, the steering link preferably includes an elongated hole formed in the upper portion thereof and extending longitudinally. The steering rod is connected to the upper portion of the steering link to be movable along the elongated hole.

Relative to a tilting direction of the propulsion machine body side (hull side), the steering link is swung via the first bracket at the hull side so that the propulsion unit is turned in the tilting direction of the hull. The propulsion unit can thus be turned in a tilting direction with respect to the propulsion machine body. The present invention can provide a small steering mechanism of a simple structure with a small number of components and a small outer shape.

The mounting portion is preferably provided with auxiliary buoyant bodies at right and left sides thereof. The mounting portion is thus prevented from tilting relative to the water surface by the auxiliary buoyant bodies, keeping the propulsion unit vertically relative to the water surface, and allowing steady propulsion and sufficient steerage by the propulsion unit.

BRIEF DESCRIPTION OF THE DRAWINGS

Preferred embodiments of the present invention will be described in detail below, by way of example only, with reference to the accompanying drawings, in which.

DETAILED DESCRIPTION OF THE PREFERRED EMBODIMENTS

Figure 1:
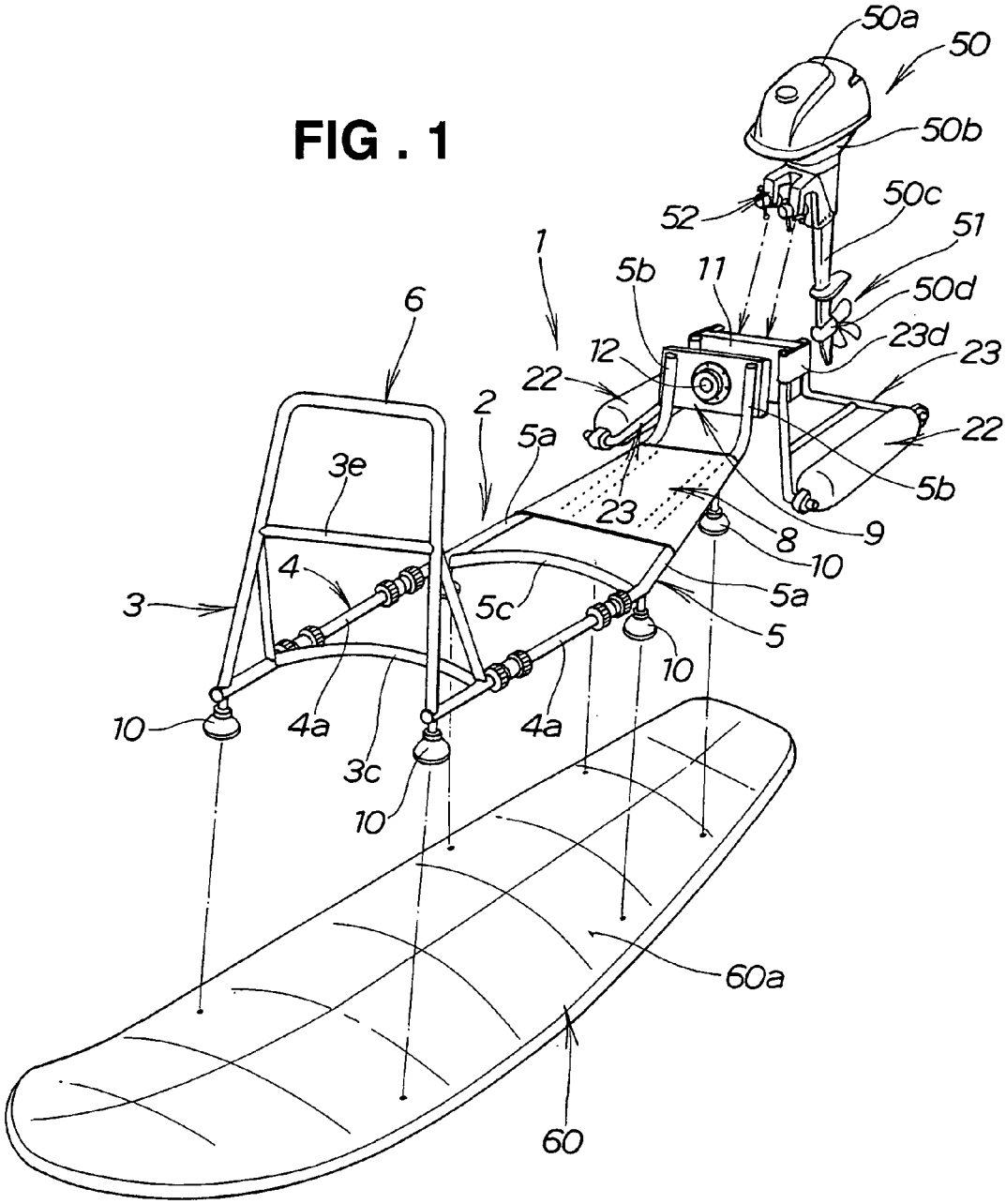
FIG. 1 is a perspective view of a propulsion machine according to a first embodiment of the present invention and a hull (surfboard) to which the propulsion machine separated is mounted.

Initial reference is made to FIG. 1 illustrating a watercraft and a propulsion machine according to a first embodiment of the present invention.

As an example of the watercraft, a hull 60 in the form of a surfboard is shown in FIG. 1. However, the present invention is not limited thereto, and may be applied to a watercraft not equipped with a propulsion machine, such as a windsurfing board or a small rowboat.

A propulsion machine 1 includes a propulsion machine body 2 and a propulsion unit 50 which is detachably mounted to the rear end of the body 2. The propulsion unit 50 is an outboard motor.

The propulsion machine body 2 is a frame made from tubular materials. The propulsion machine body 2 includes a front body part 3, a middle body part 4, and a rear body part 5. The rear body part 5 includes a mounting portion 11 for swingably mounting the outboard motor 50 to the propulsion machine body 2.

Figure 2:
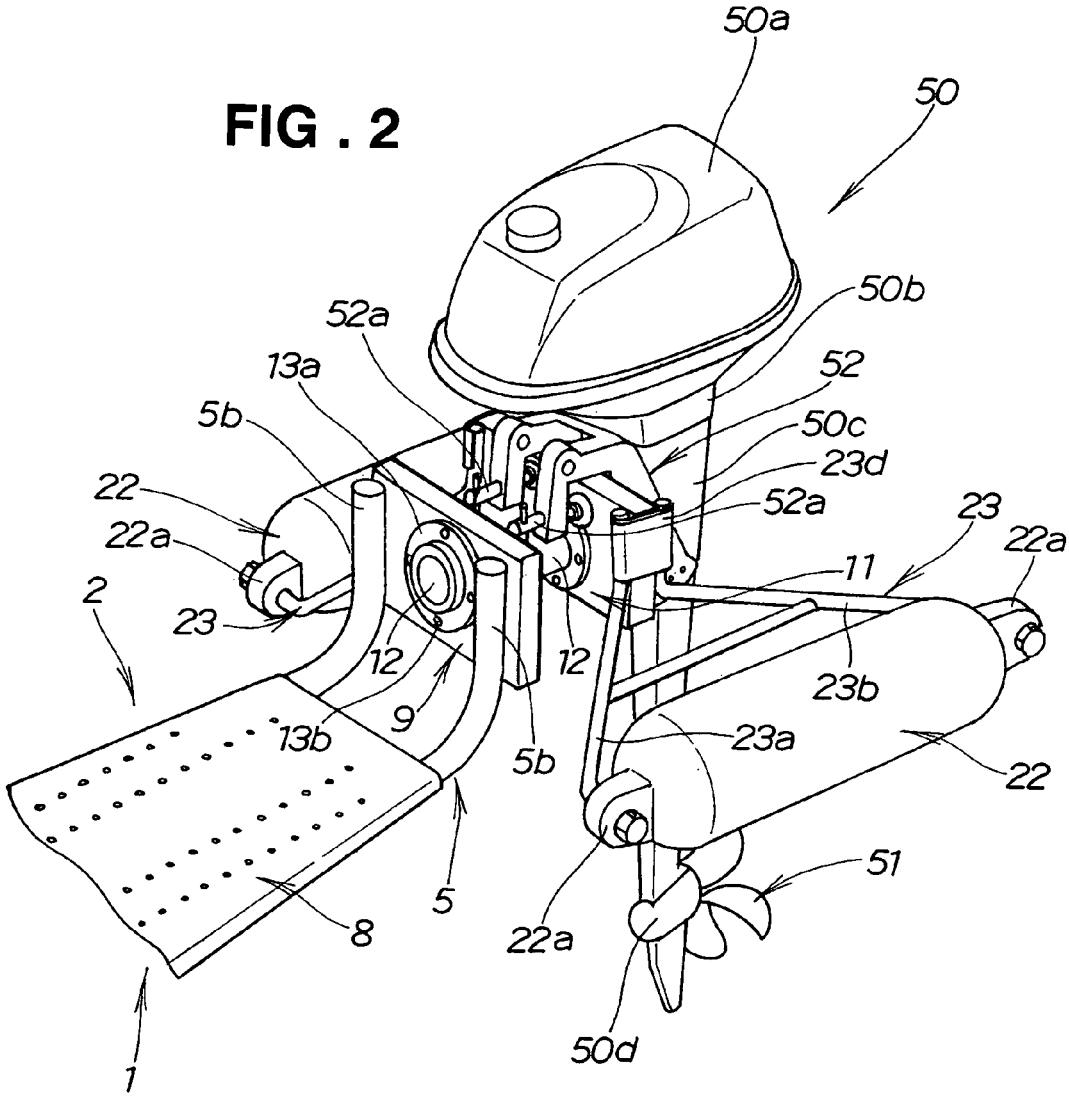
FIG. 2 is a partial enlarged perspective view of a rear portion of the propulsion machine shown in FIG. 1 to which an outboard motor and auxiliary buoyant bodies are mounted.

As shown in FIG. 2, the outboard motor 50 includes an uppermost engine cover 50*a*, an under cover 50*b* located below the cover 50*a*, an extension case 50*c* extended vertically downward from the cover 50*b*, and a gear case 50*d* provided at the bottom of the case 50*c*.

The engine cover 50*a* and the under cover 50*b* house an engine, a fuel tank and a fuel system not shown.

A drive shaft vertically passes through the extension case 50*c*, and drives a propeller 51 provided at the rear of the gear case 50*d* by the drive from the engine.

A stern bracket 52 for supporting the outboard motor 50 in a vertically swingable manner is provided at the extension case 50*c*.

The outboard motor 50 includes a swivel shaft 53 for steering (see FIG. 19), and the stern bracket 52 is rotatably mounted on the swivel shaft 53.

The stern bracket 52 shown as an example is in a forked shape in a plan view and in an inverted U shape in a side view, and is engaged with the mounting portion 11 from above and secured to the mounting portion 11 by right and left clamps 52*a*, 52*a*.

Next, the propulsion machine body 2 will be described with reference to FIGS. 1, 3, 4 and 5.

The front body part 3 of the propulsion machine body 2 includes a handle 6. The middle body part 4 includes right and left middle rod members 4*a*, 4*a* extending longitudinally. The front ends of the middle rod members 4*a*, 4*a* are connected to the front body part 3 via connecting members 7, 7 which are adjustable in length. Also, the rear ends of the middle rod members 4*a*, 4*a* are connected to the front ends of right and left rear rod members 5*a*, 5*a* of the rear body part 5 via connecting members 7, 7 which are adjustable in length. A reinforcing crossmember 5*c* curved upward is provided between front end portions of the right and left rear rod members 5*a*, 5*a*.

In this embodiment, the hull 60 is a surfboard. Since the surfboard has a shape narrowing in width from the middle to the rear, the right and left rear rod members 5*a*, 5*a* of the rear body part 5 are formed to have a smaller space therebetween from the front ends to the rear. Rear end portions thereof are bent upward substantially in an L shape, forming upright portions 5*b*, 5*b*.

A base plate 8, which is trapezoidal in a plan view and has a large width at the front and a small width at the rear, is provided across the right and left rear rod members 5*a*, 5*a* from middle portions to rear portions thereof. The base plate 8 also serves as a reinforcing member between the rear rod members 5*a*, 5*a*.

A fixed support plate 9 made from a plate member is provided substantially vertically between the right and left upright portions 5*b*, 5*b* of the propulsion machine body 2.

Suction cups 10, 10 are provided on right and left bottom surfaces at the front part of the propulsion machine body 2, that is, on the right and left of the front body part 3. Four suction cups 10 are provided at front and rear portions of the right and left rear rod members 5*a*, 5*a*, respectively. These suction cups 10 constitute a mounting mechanism for detachably mounting the propulsion machine 1 to the hull 60.

Figure 3:
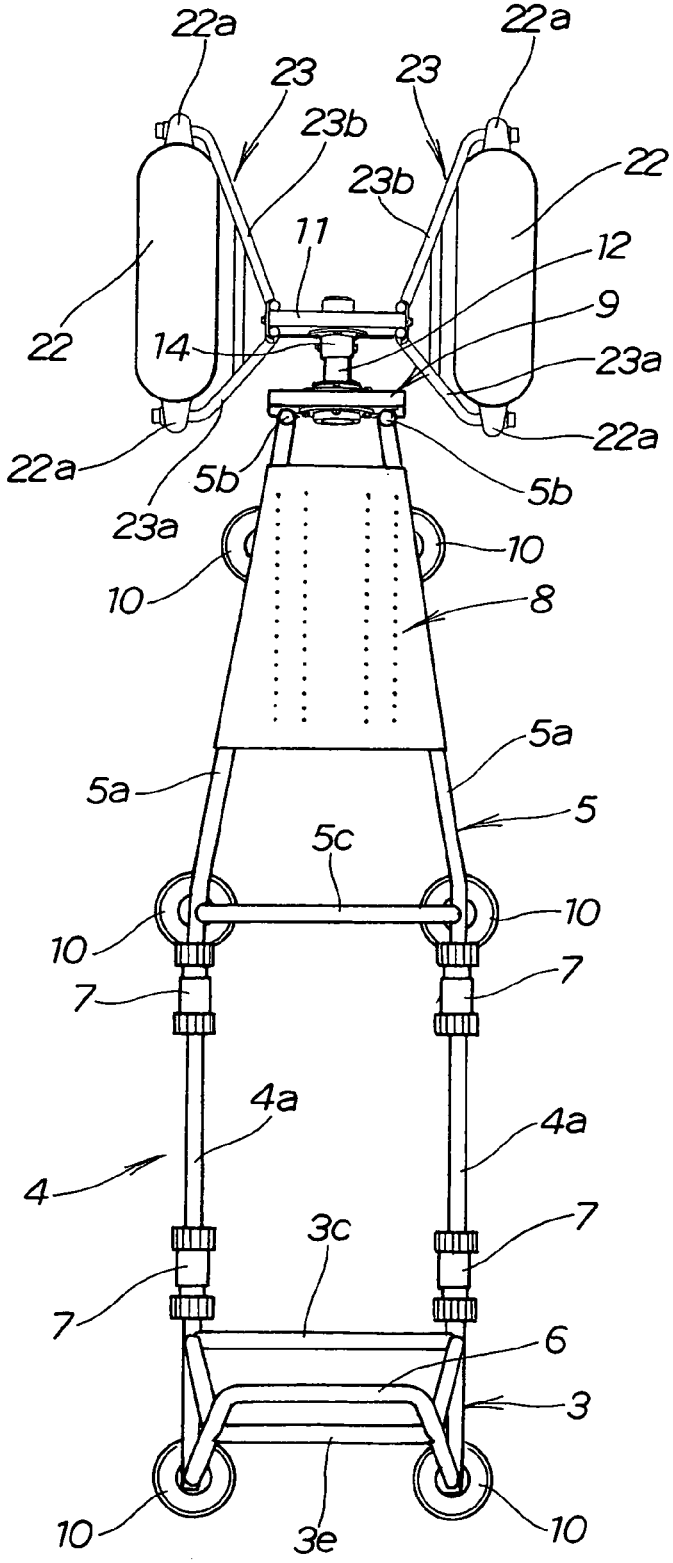
FIG. 3 is a plan view of the propulsion machine body shown in FIG. 1.

In the embodiment shown, six suction cups 10 are provided as clearly shown in FIG. 3 by way of example. The number of suction cups 10 provided is not limited to the above number, and can be determined desirably. For example, depending on the size of the propulsion machine body 2, three may be provided with two at the front part and one at the rear part, or five in total with four at the front and middle parts and one at the rear part, or more than seven in total.

The propulsion machine body 2 is opposed to an upper surface 60*a* of the hull 60 as shown in FIG. 1, and the suction cups 10 are stuck to the upper surface 60*a* of the hull 60 as shown by chain lines. With this, the propulsion machine body 2 is detachably mountable to the hull 60.

FIGS. 6 to 9 illustrate a mounting portion for a propulsion unit to be mounted to the propulsion machine body 2 and mounting portions for auxiliary buoyant bodies.

Figure 4:
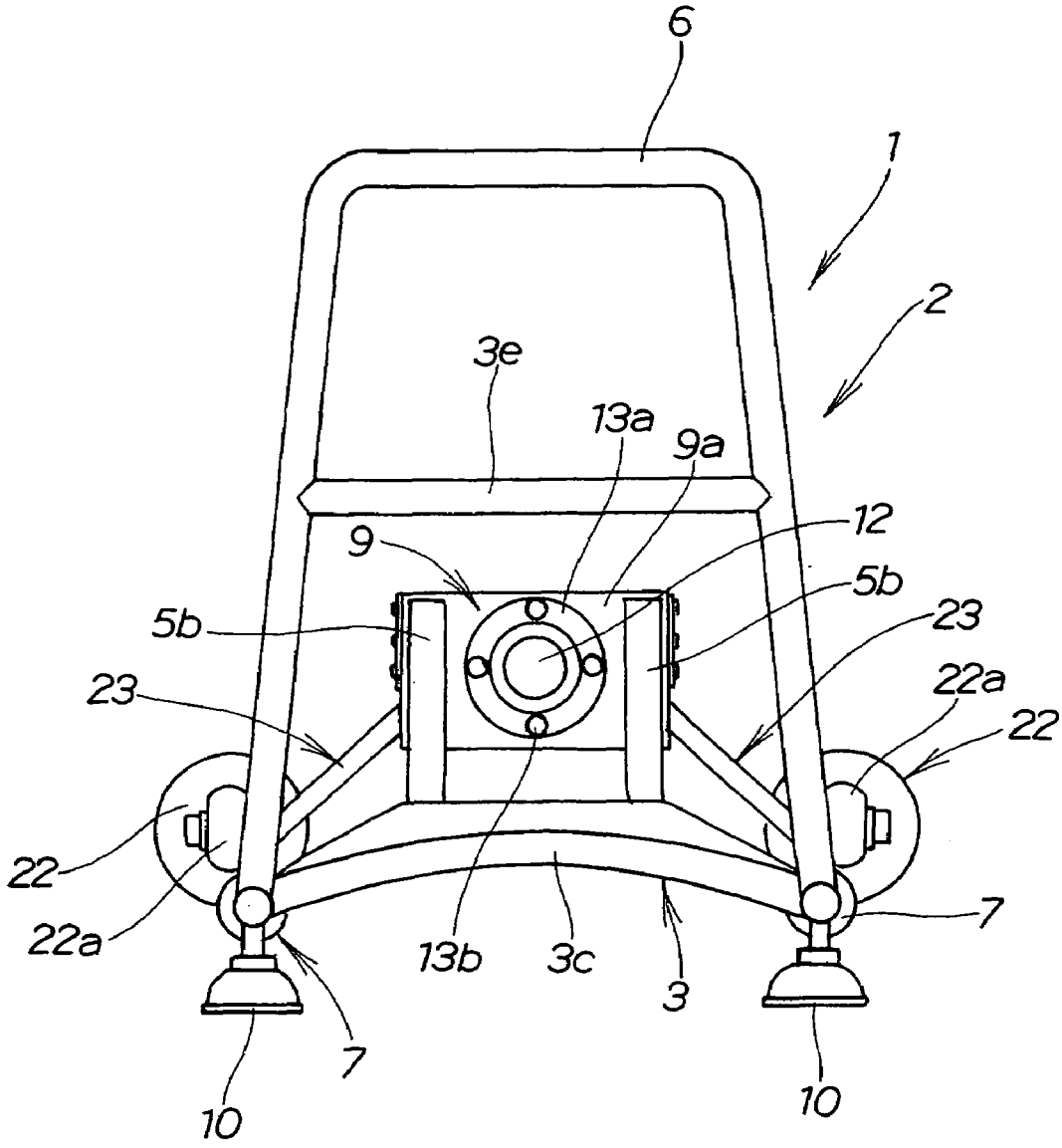
FIG. 4 is a front view of the propulsion machine body shown in FIG. 3.
Figure 5:
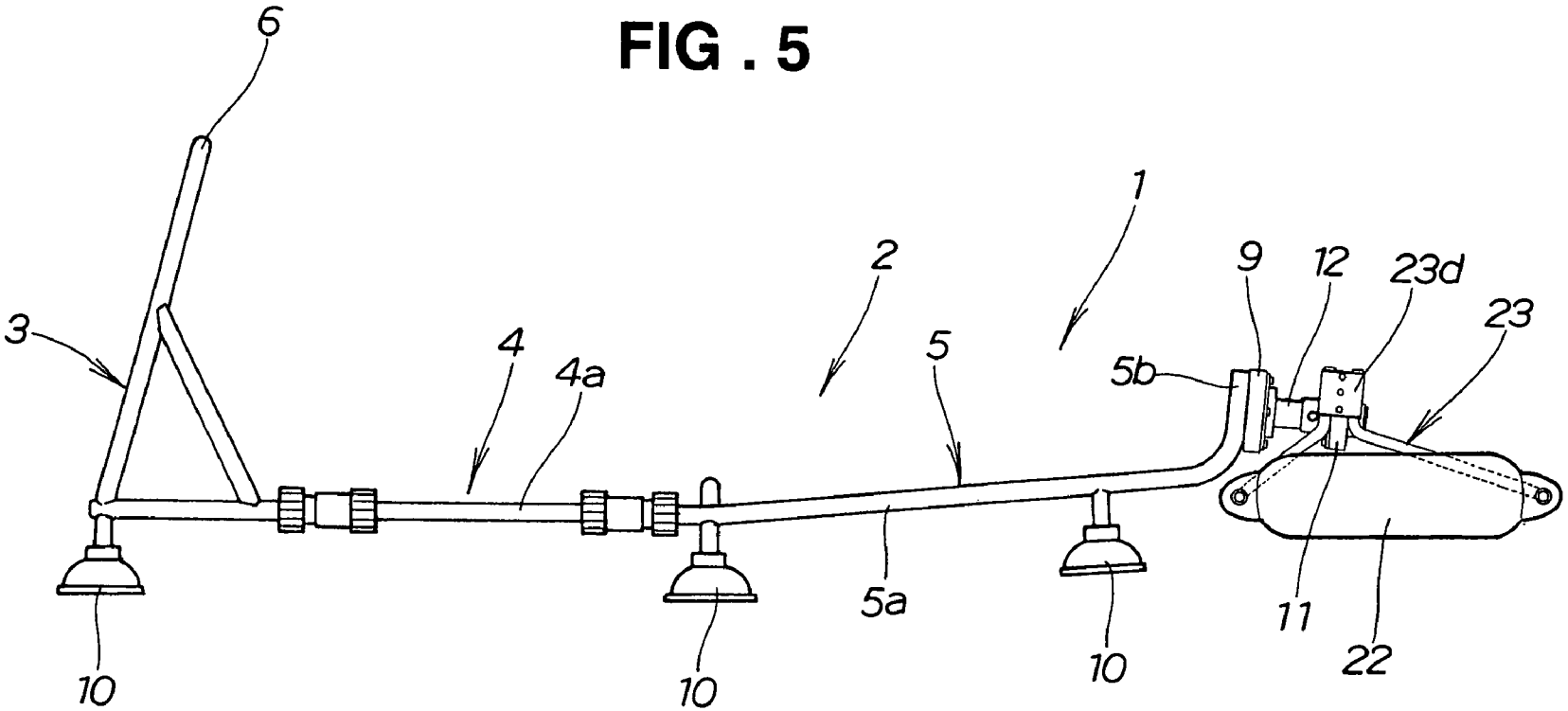
FIG. 5 is a side view of the propulsion machine body shown in FIG. 3.

As shown in FIG. 4, the support plate 9 is, at opposite side portions of its front surface 9*a*, fixed to and supported by the L-shaped upright portions 5*b*, 5*b* at a rear end portion of the propulsion machine body 2.

Figure 9:
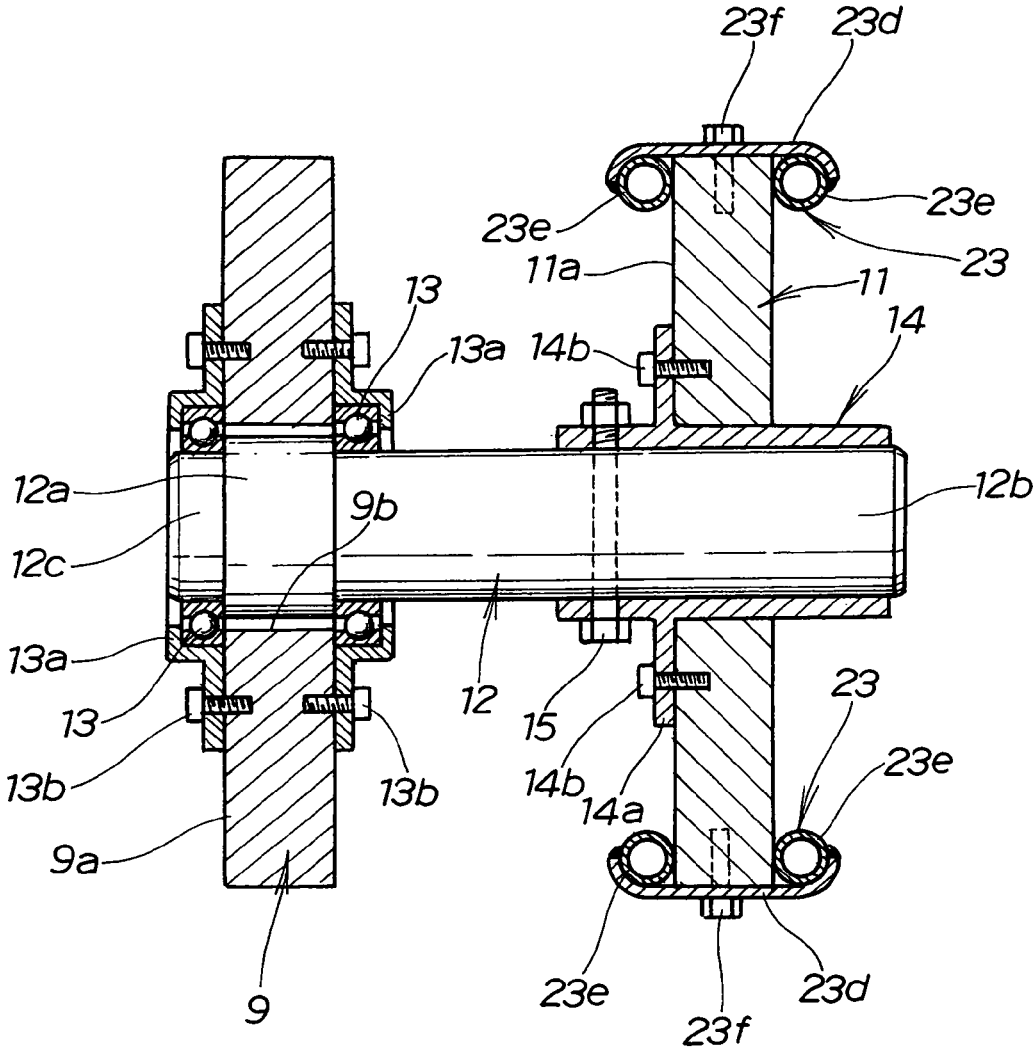
FIG. 9 is a cross-sectional view along line 9—9 in FIG. 8.

As shown in FIG. 9, the mounting portion 11 constituting the rearmost end of the propulsion machine body 2, to which the outboard motor (propulsion unit) 50 is mounted, is disposed rearward of the support plate 9 at a predetermined distance. Like the support plate 9, the mounting portion 11 is made from a plate member in the embodiment shown. Instead of being a plate member, it may be a surrounding frame structure.

The mounting portion 11 is supported swingably with respect to the forward-located support plate 9, that is, with respect to the propulsion machine body 2 via a rotary shaft 12 which is oriented in a longitudinal direction.

As shown in FIG. 9, a sleeve 14 passes through a central portion of the mounting portion 11. A flange 14*a* of the sleeve 14 is fixed to a front surface 11*a* of the mounting portion 11 by screws 14*b*, 14*b*. A rear half portion 12*b* of the rotary shaft 12 is fitted in the sleeve 14. The sleeve 14 is fixed by a locking through bolt 15 so as not to rotate relative to the rotary shaft 12. Thus, the mounting portion 11 is non-rotatable with respect to the rotary shaft 12.

A large-diameter boss 12*a* at a front half portion 12*c* of the rotary shaft 12 is located in a support hole 9*b* formed in the support plate 9. The large-diameter boss 12*a* is supported at the front and rear by bearings 13,13, whereby the rotary shaft 12 is rotatably supported by the support elate 9.

The bearings 13, 13 are fixed to the front and rear peripheries of the support hole 9*b* by attaching support fittings 13*a*, 13*a* to the front and rear surfaces of the support plate 9 by a plurality of screws 13*b*.

As described above, since the rotary shaft 12 fixed to the mounting portion 11 is rotatably supported by the fixed support plate 9, the mounting portion 11 swings on the rotary shaft 12 with respect to the support plate 9. That is, the propulsion unit 50 mounted to the mounting portion 11 is swingable or pivotable about the axis of the shaft 12 relative to the propulsion machine body 2 fixedly supporting the support plate 9. In this manner, the propulsion unit 50 maintains a vertical operatincr position when the propulsion machine body 2 together with the hull 60 rolls about the axis of the shaft 12.

Figure 6:
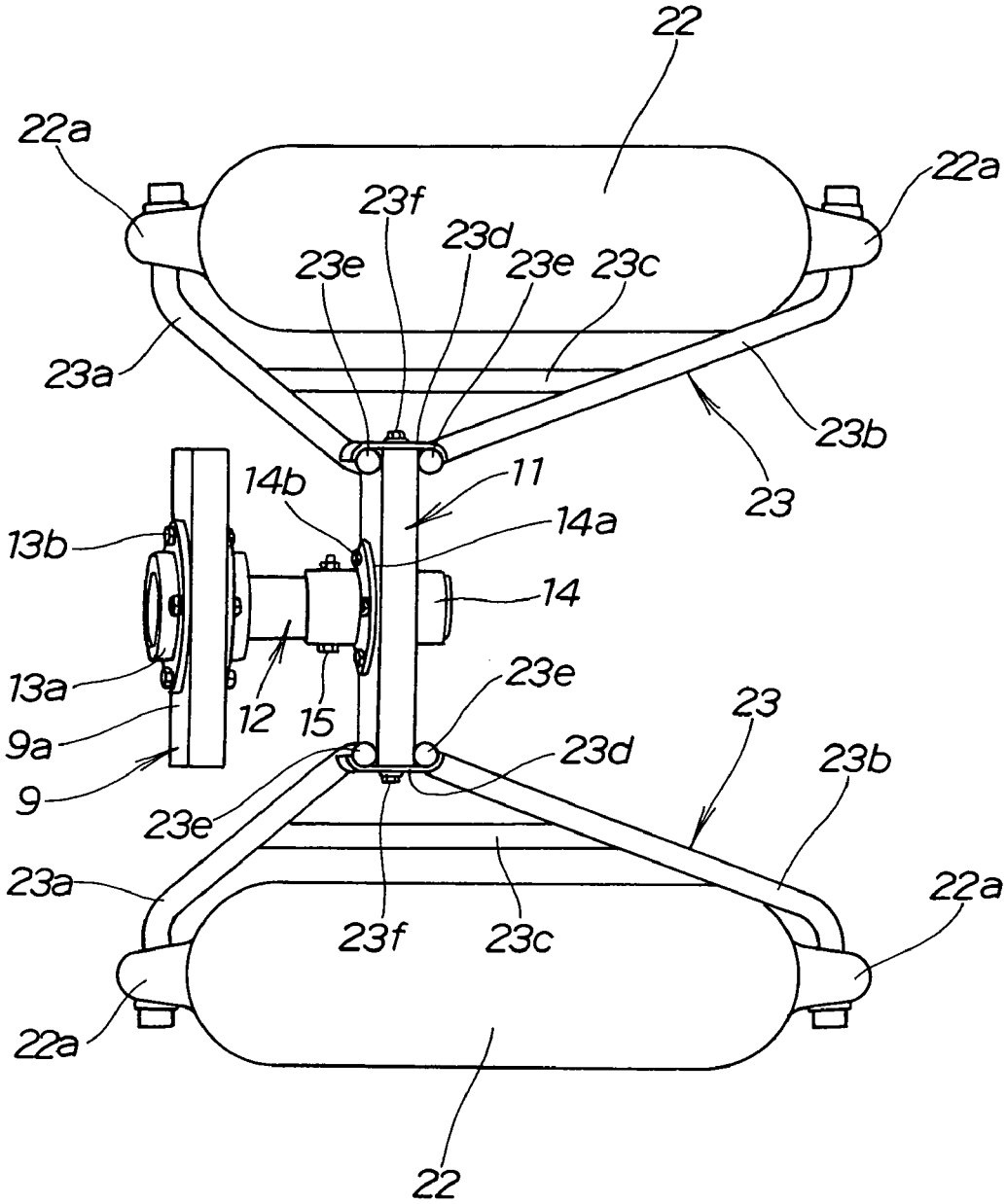
FIG. 6 is an enlarged plan view of a mounting portion and the auxiliary buoyant bodies shown in FIG. 3.

As shown in FIG. 6, right and left auxiliary buoyant bodies 22, 22 are mounted to the right and left ends of the mounting portion 11. The auxiliary buoyant bodies 22, 22 are longitudinally elongated floats and supported symmetrically by support stays 23, 23 which are substantially V-shaped in a plan view, extending symmetrically outward. The support stays 23, 23 are substantially L-shaped in a front view, inclined outward.

Figure 7:
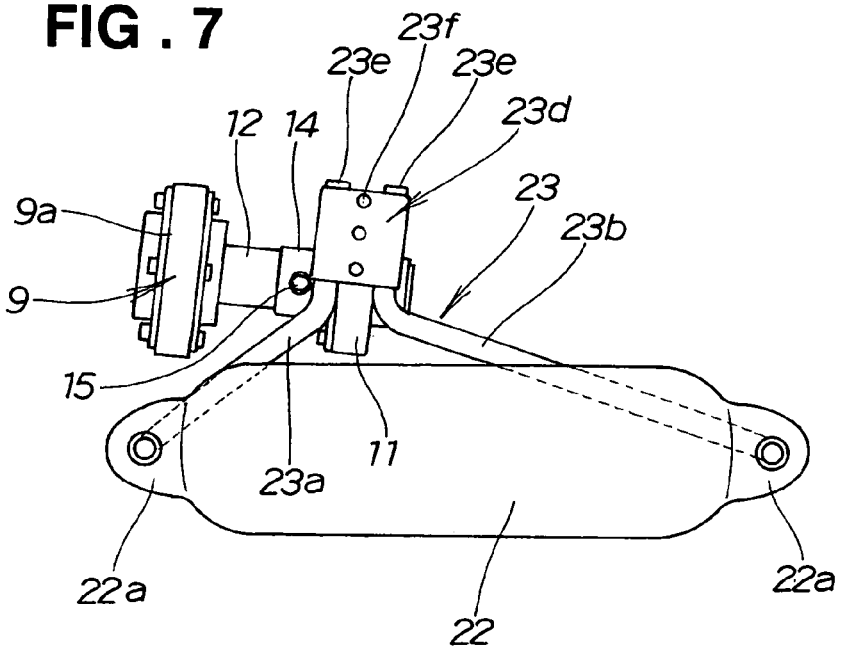
FIG. 7 is a side view of FIG. 6.

As shown in FIG. 7, the auxiliary buoyant bodies 20, 20 are, at mounting portions 22*a*, 22*a* thereof, connected to and supported by the lower ends of front and rear members 23*a* and 23*b* of the support stays 23, 23, oriented longitudinally therebetween.

Upper end portions 23*e*, 23*e* of the front and rear members 23*a* and 23*b* of each support stay 23 are symmetrically bent to form a small longitudinal distance therebetween. The upper end portions 23*e*, 23*e* are vertically fixed by welding or the like to inner surfaces at front and rear edge portions of a connecting plate 23*d*. The connecting plate 23*d* is fixed to the mounting portion 11 by a plurality of screws 23*f*.

As described above, the auxiliary buoyant bodies 22, 22 are mounted to both sides of the mounting portion 11 in such a manner as to hang downward, protruding outward to the right and left sides.

Figure 10:
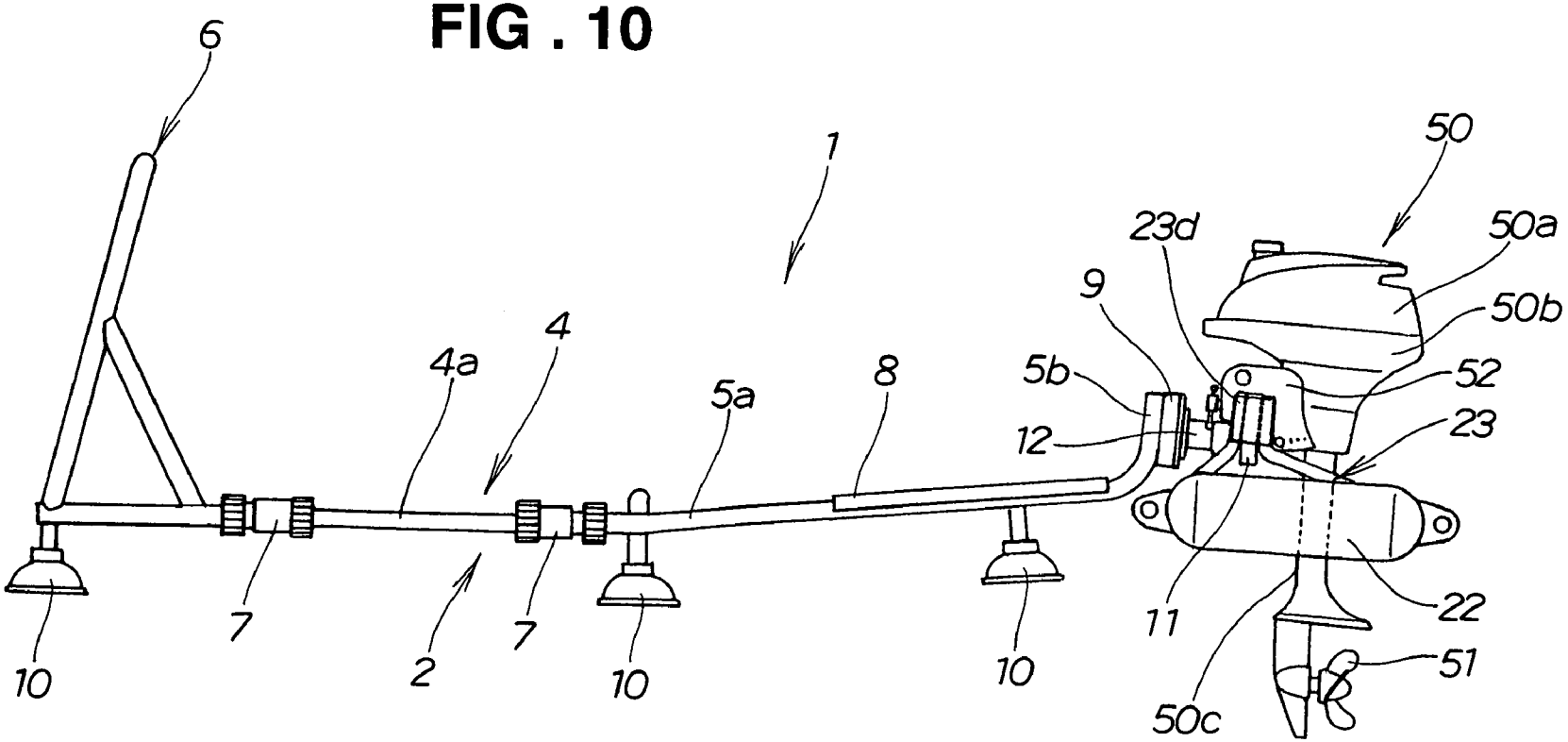
FIG. 10 is a side view of the propulsion machine with the outboard motor as a propulsion unit mounted to the mounting portion.

FIG. 10 illustrates the outboard motor 50 mounted to the swingable mounting portion 11 which is provided at the rear end of the propulsion machine body 2.

The mounting portion 11 provided rearward of and opposite to the support plate 9 which is provided at the rear of the propulsion machine body 2, is fixed on the rotary shaft 12 provided rotatably relative to the support plate 9, and is swingable via the rotary shaft 12 relative to the support plate 9. The outboard motor 50 is supported by the mounting portion 11 via the stern bracket 52. The mounting portion 11 has the auxiliary buoyant bodies 22, 22 protruding downward and outward on the right and left.

Figure 11:
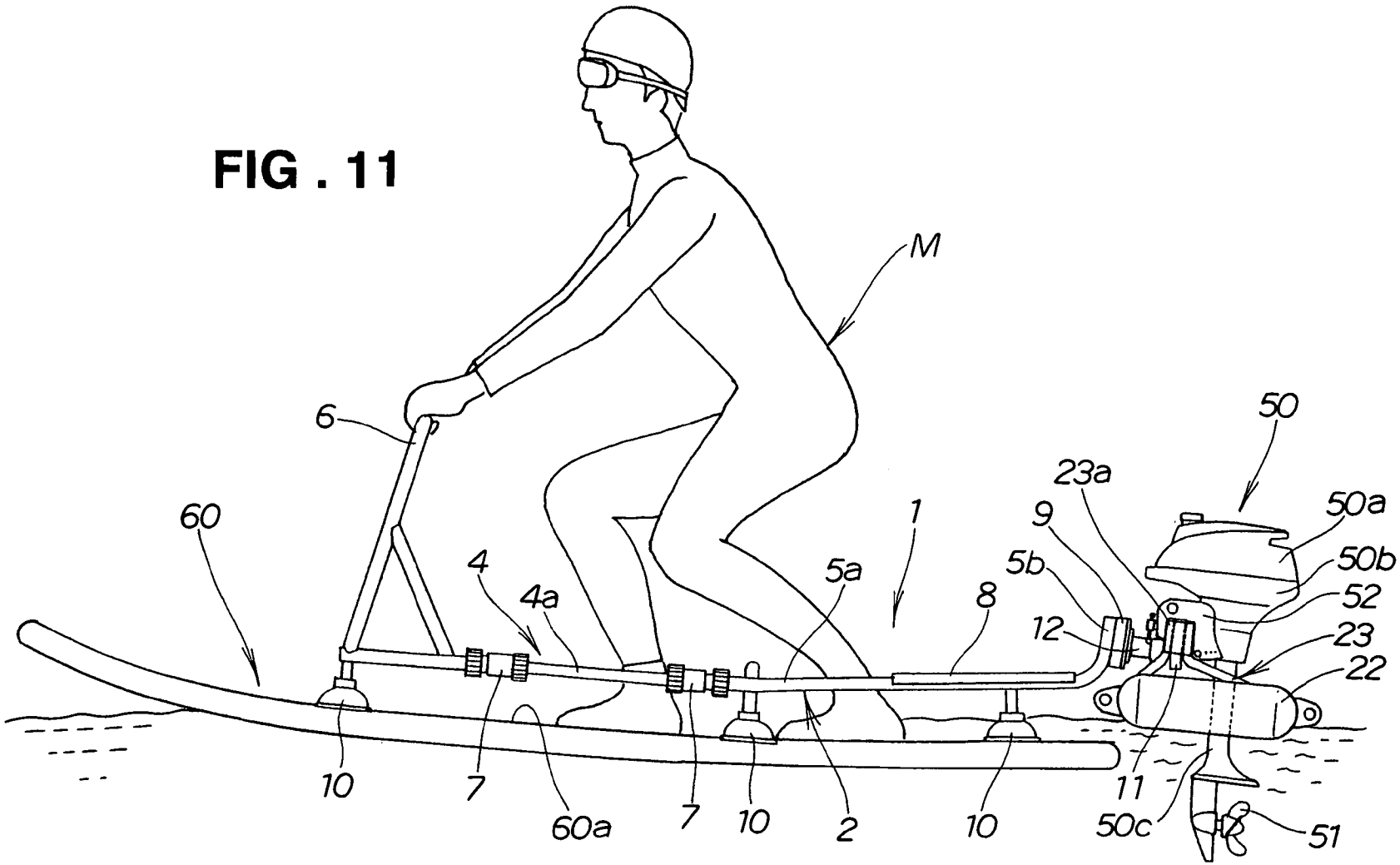
FIG. 11 is a side view illustrating a situation in which a player is riding and steering on the hull to which the propulsion machine with the outboard motor mounted to the mounting portion is mounted.

FIG. 11 illustrates a situation where the propulsion machine 1 is mounted to the hull 60, and an operator is riding and steering thereon.

The operator M rides on the hull 60 in a surfing style, grasping or without grasping the handle 6. The outboard motor 50 and the auxiliary buoyant bodies 20, 20 provided at the rear end of the propulsion machine body 2 are located rearward of the stern. The auxiliary buoyant bodies 20, 20 float on the water. The propeller 51 is submerged. The hull 60 obtains propulsive power by driving the outboard motor 50.

Figure 12:
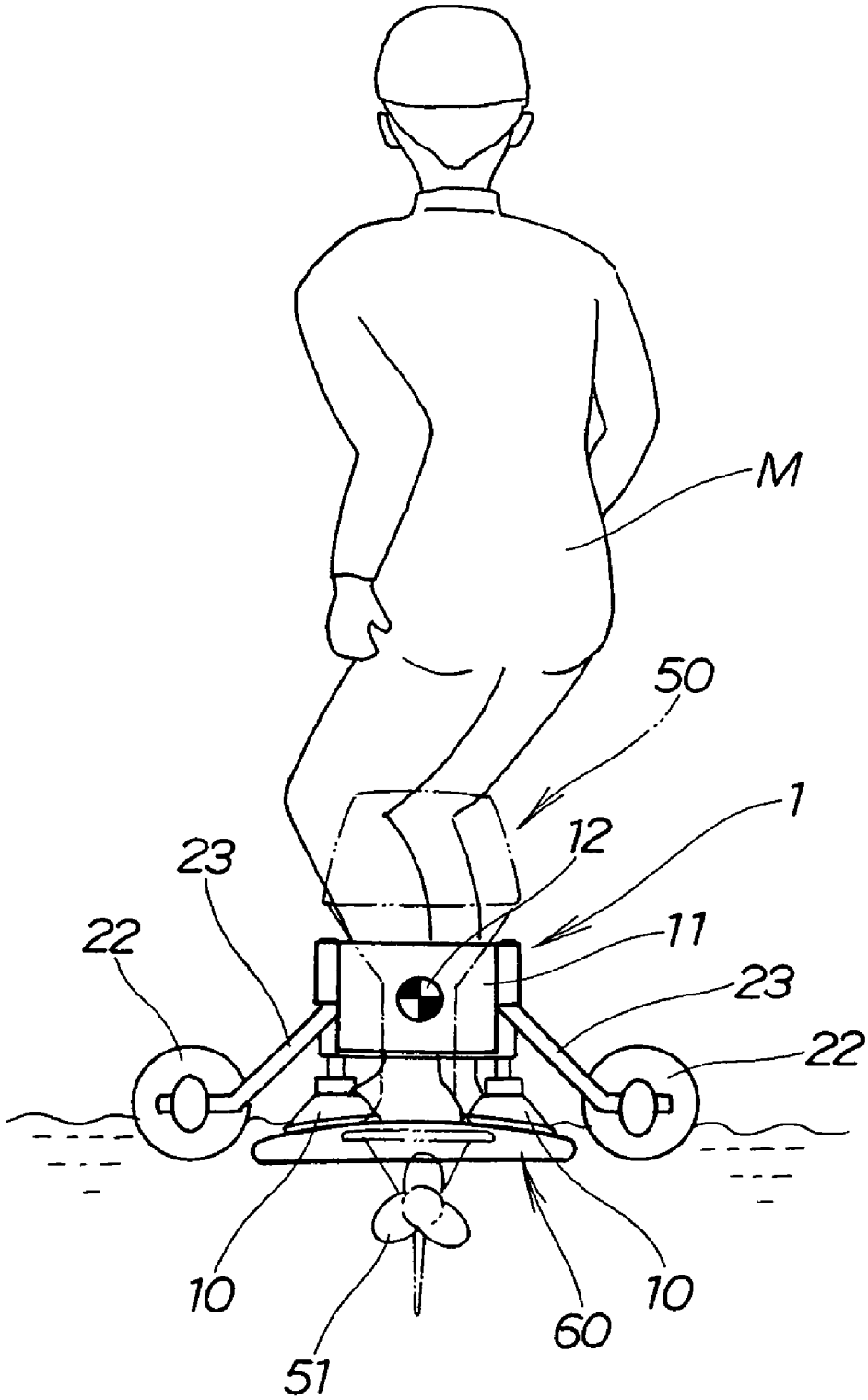
FIG. 12 is a view illustrating a situation in which a player is riding and steering on the hull to which the propulsion machine according to the present invention is mounted, and illustrating the position of the hull in a normal state.
Figure 13:
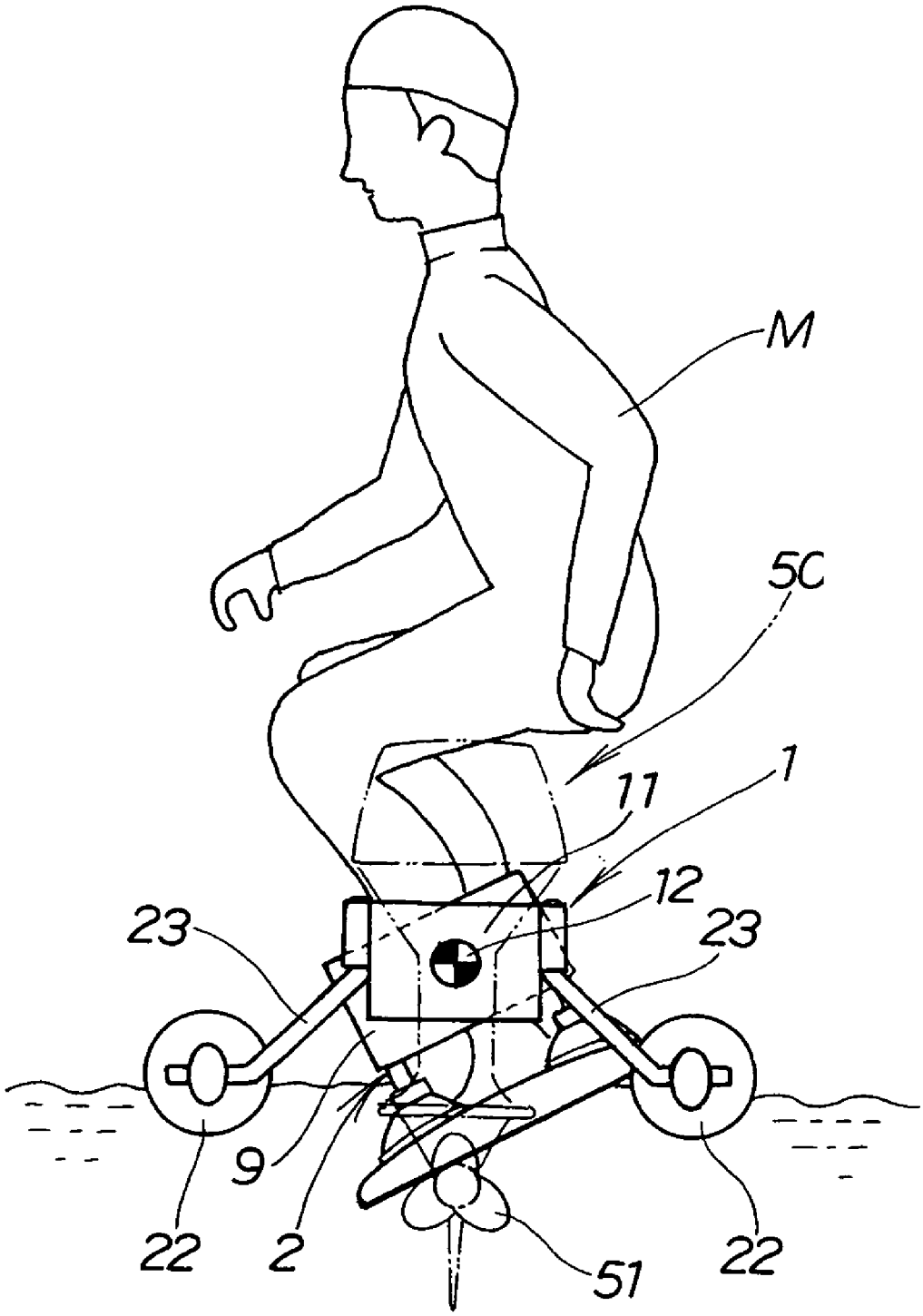
FIG. 13 is a view illustrating a situation in which a player is steering, tilting the hull by weight shift from the normal state in FIG. 12.

FIGS. 12 and 13 illustrate an operator riding on the hull 60 equipped with the propulsion machine 1 according to the present invention; FIG. 12 illustrates a normal state; and FIG. 13 a steering state by shifting the center of gravity.

In the normal state shown in FIG. 12, the hull 60 floats substantially horizontally, being submerged or half-submerged by the weight of the operator M. Although the outboard motor 50 at the rear end portion of the propulsion machine 1 has a large weight, the buoyancy of the auxiliary buoyant bodies 22, 22 prevents the rear end portion from submerging. The auxiliary buoyant bodies 22, 22 are exposed on the water or half-submerged.

FIG. 13 illustrates the propulsion machine 1 (propulsion machine body 2) including the hull 60 tilted sideways by a shift of the weight of the operator M. The figure shows tilting to the left.

The outboard motor 50 and the auxiliary buoyant bodies 22, 22 at the rearmost end, including the mounting portion 11, are swingable on the rotary shaft 12 with respect to the propulsion machine body 2.

When the operator M shifts his weight on the hull 60, the hull 60 tilts to the right or left. With the tilt of the hull 60, the body 2 of the propulsion machine 1 tilts to the right or left.

Since the auxiliary buoyant bodies 22,22 maintain their buoyancy on the water at the right and left, the auxiliary buoyant bodies 22,22 and the outboard motor 50, which are supported by the mounting portion 11 mounted swingably via the rotary shaft 12 to the support plate 9 at the rearmost part of the propulsion machine body 2, constitute a non-swinging part on the water. The outboard motor 50 and the auxiliary buoyant bodies 22,22 constitute a fixed part.FIG. 13 shows this. The hull 60 is tilted sideways by a the operator shifting his weight for the play of tilting on the water.

At that time, even with the hull 60 tilting sideways on the water, the auxiliary buoyant bodies 22, 22 and the outboard motor 50 maintain their horizontal states, keeping the balance of the entire hull 60. Also, the propulsive power of the outboard motor 50 acts normally.

Next, a watercraft propulsion machine according to a second embodiment of the present invention will be schematically described with reference to FIGS. 14 to 16. Members identical to those described in the first embodiment are given the same reference numerals in description.

Figure 14:
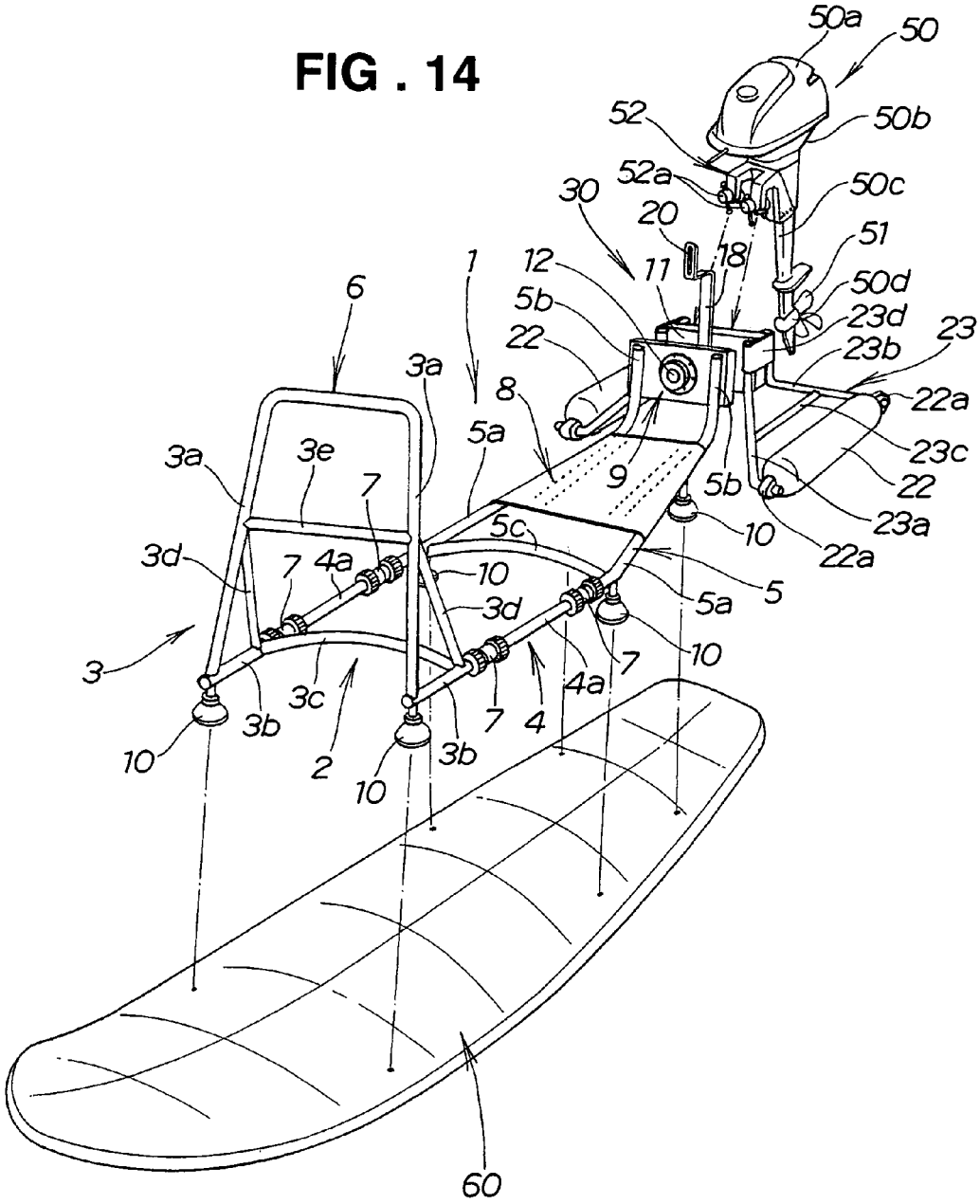
FIG. 14 is an exploded perspective view of a watercraft and a propulsion machine according to a second embodiment of the present invention.
Figure 15:
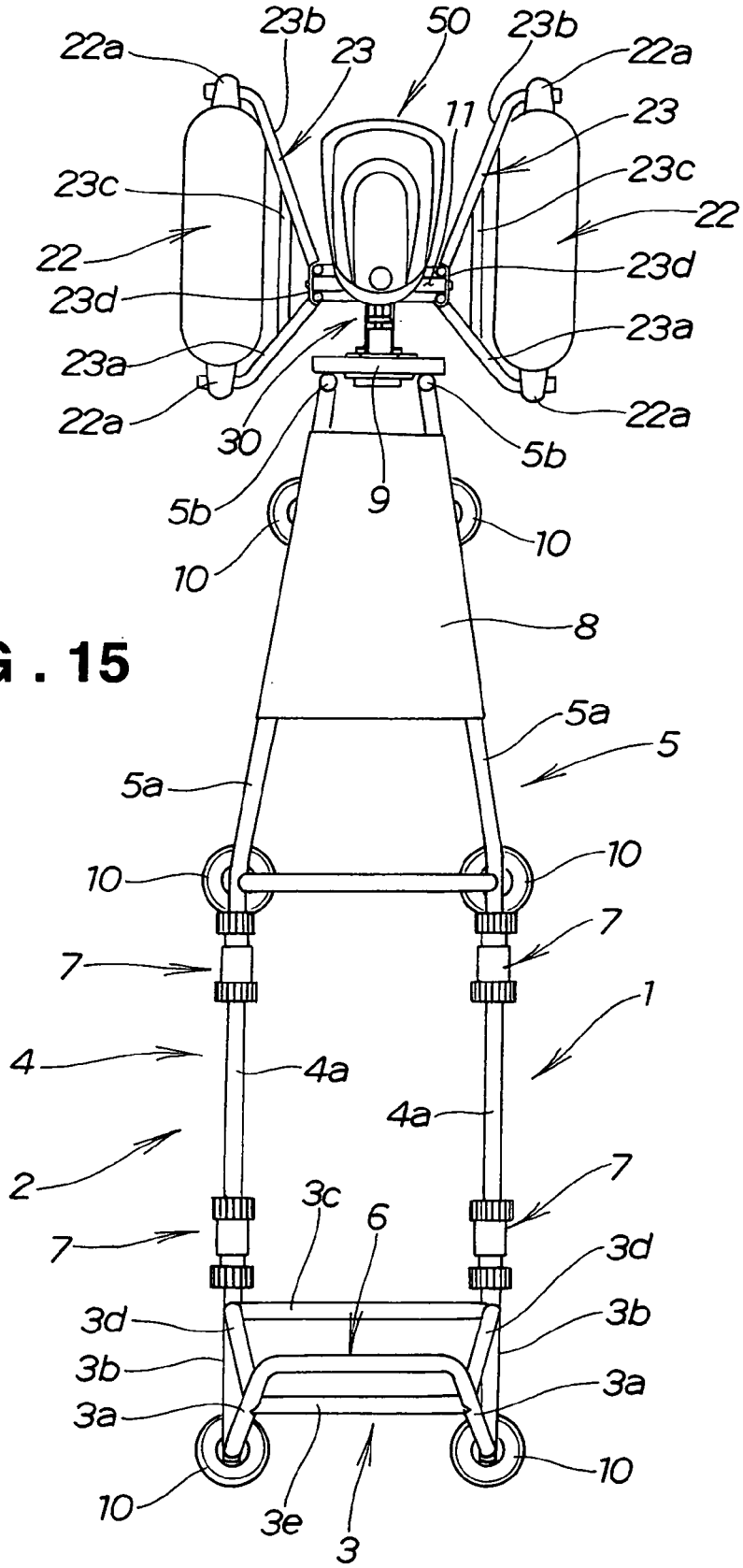
FIG. 15 is a plan view of the propulsion machine to which a propulsion unit shown in FIG. 14 is mounted.
Figure 16:
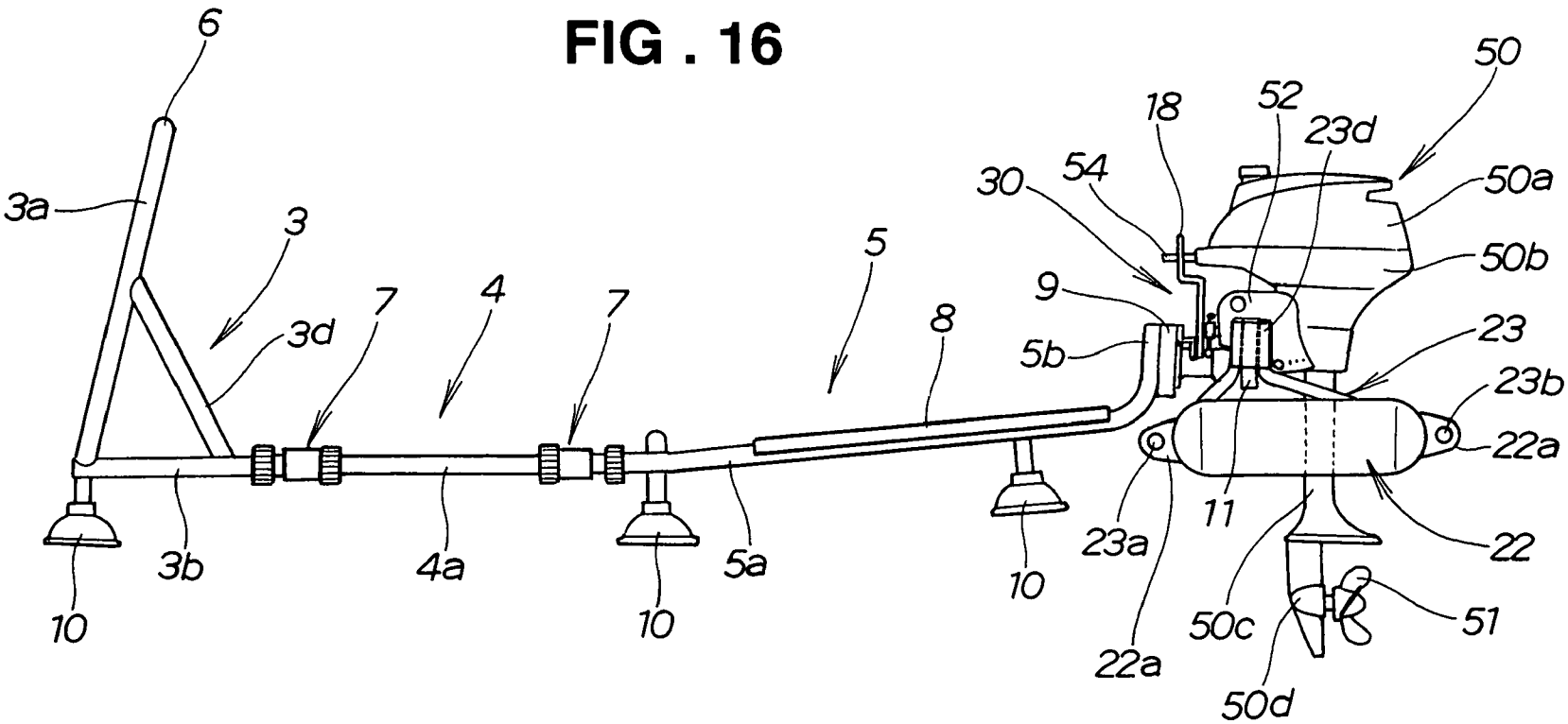
FIG. 16 is a side view of the propulsion machine shown in FIG. 15.

FIGS. 14 to 16 illustrate a watercraft and a propulsion machine according to the second embodiment of the present invention.

In the figures, a surfboard is illustrated as an example of the watercraft. A propulsion machine 1 is detachably mounted on a hull 60 in the form of a surfboard.

A propulsion machine body 2 of the propulsion machine 1 is a tubular frame made up of tubular materials, and includes a front body part 3, a middle body part 4 and a rear body part 5 in a longitudinal direction of the surfboard. The rear body part 5 includes a mounting portion 11 which is swingable relative to the propulsion machine body 2. A propulsion unit 50 is detachably mountable to the mounting portion 11.

The propulsion unit 50 is an outboard motor in the illustrated example. The outboard motor 50 includes an uppermost engine cover 50*a*, an under cover 50*b* located therebelow, an extension case 50*c* extended vertically downward therebelow, and a gear case 50*d* provided at the bottom thereof. The covers 50*a* and 50*b* house an engine, a fuel tank and the like. A drive shaft vertically passes through the extension case 50*c*, and drives a propeller 51 provided rearward of the gear case 50*d*.

The outboard motor 50 includes a swivel shaft 53 (see FIG. 19) and a stern bracket 52 mounted rotatably relative to the swivel shaft 53. The swivel shaft 53 constitutes a steering axis of the outboard motor 50.

The stern bracket 52 shown as an example is in a forked shape in a plan view and in an inverted U shape in a side view, and is engaged with the mounting portion 11 from above and attached to the mounting portion 11 by right and left clamps 52*a*, 52*a*.

Referring to FIGS. 14, 15 and 16, the front body part 3 of the propulsion machine body 2 is provided, at the forefront, with a grip handle 6 in an inverted U shape in a front view, slightly inclined rearward. The front body part 3 is provided, at the lower ends of right and left vertical rod members 3*a*, 3*a*, with right and left front rod members 3*b*, 3*b* extending longitudinally of the body 2, and an upward-curved crossmember 3*c* provided between the rear ends of the front rod members 3*b*, 3*b*.

Also, reinforcing rod members 3*d*, 3*d* are provided obliquely between the vertical rod members 3*a*, 3*a* and the rear ends of the front rod members 3*b*, 3*b*. A crossmember 3*e* is provided between vertically middle portions of the vertical rod members 3*a*, 3*a*.

Right and left middle rod members 4*a*, 4*a* are connected at their front ends to the rear ends of the right and left front rod members 3*b*, 3*b* of the front body part 3 via connecting members 7, 7 which are adjustable in length. Right and left rear rod members 5*a*, 5*a* of the rear body part 5 are connected at their front ends to the rear ends of the middle rod members 4*a*, 4*a* via similar connecting members 7, 7 to be adjustable in length.

The middle body part 4 is constituted by the right and left middle rod members 4*a*, 4*a* as described above. The middle body part 4 is adjustable in length in a longitudinal direction of the propulsion machine body 2 via the connecting members 7. That is, the distance between the front body part 3 and the rear body part 5 is adjustable. With this, the longitudinal length of the propulsion machine body 2 can be adjusted to the length of the hull 60.

The right and left rear rod members 5*a*, 5*a* of the rear body part 5 are formed to have a large distance between their front ends and a small distance between their rear ends, having a gradually narrowing distance toward the rear.

A crossmember 5*c* curved upward is provided between the front ends of the right and left rear rod members 5*a*, 5*a*, and a base plate 8 is mounted thereon from their middle portions to rear portions.

The right and left rear rod members 5*a*, 5*a* include at their rear ends upright portions 5*b*, 5*b* bent upward in an L shape in parallel on the right and left. The support plate 9 is vertically provided between the upright portions 5*b*, 5*b*.

The propulsion machine body 2 has a plurality of suction cups 10 provided in a downwardly hanging and protruding manner. These suction cups 10 constitute a mounting mechanism for detachably mounting the propulsion machine 1 to the hull 60. Specifically, six suction cups 10 are provided in total; two suction cups 10, 10 are provided at bottom portions of the right and left front rod members 3*b*, 3*b* of the front body part 3; and four suction cups 10 are provided at the front ends and the rear ends of the right and left rear rod members 5*a*, 5*a* of the rear body part 5, respectively. The positions and the number of suction cups 10 provided can be determined desirably. Also, the mounting mechanism is not limited to suction cups, and can be made desirably.

The mounting portion 11 to which the outboard motor 50 as a propulsion unit is mounted is disposed rearward of the support plate 9 which is provided at the rear of the propulsion machine body 2. The mounting portion 11 is supported by the rotary shaft 12 which is mounted rotatably with respect to the support plate 9 and oriented in a longitudinal direction.

Figure 17:
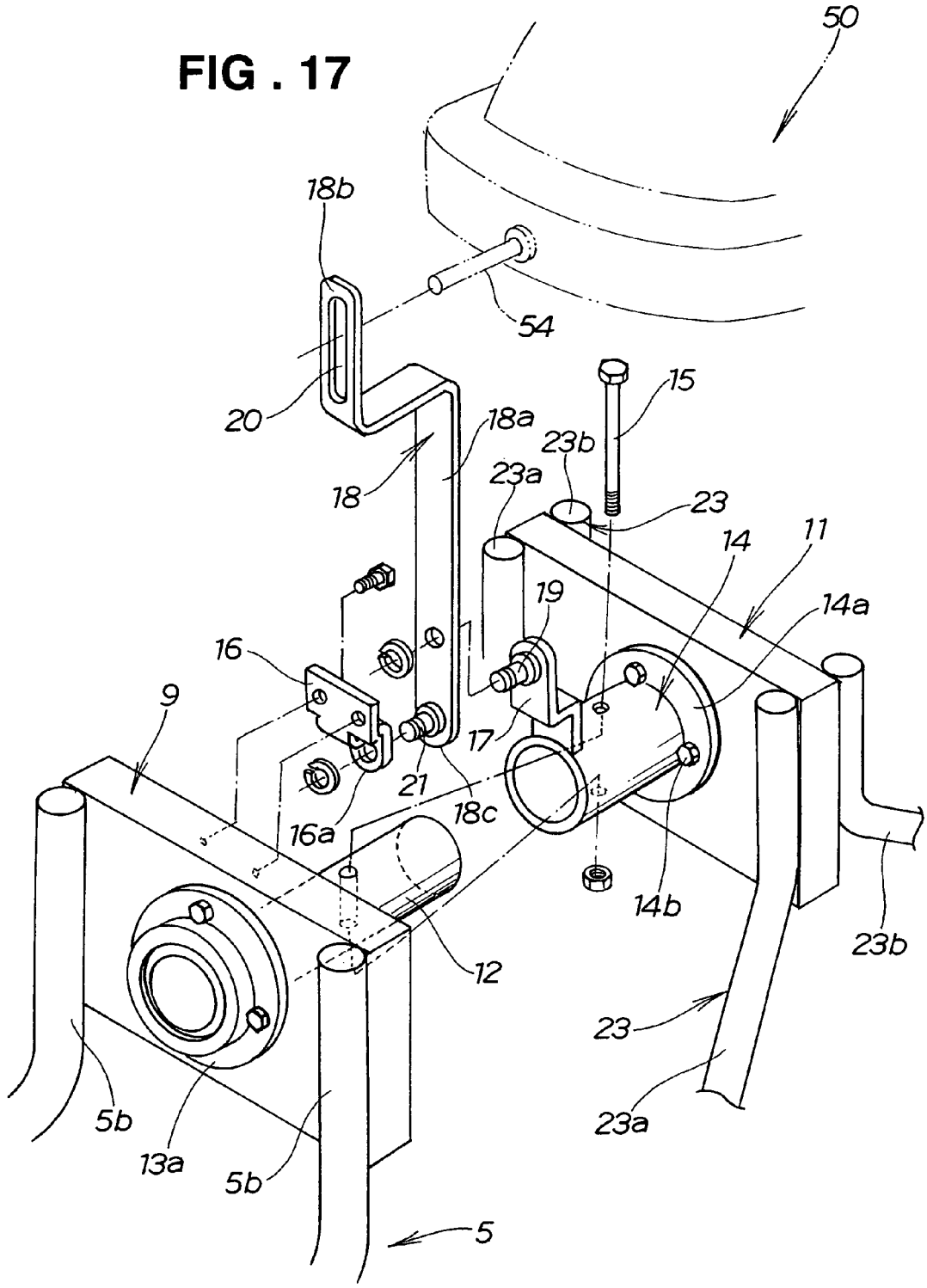
FIG. 17 is an exploded perspective view of a support plate and a mounting portion, and a conversion mechanism provided therebetween for a conversion to a steering movement of the propulsion unit.
Figure 18:
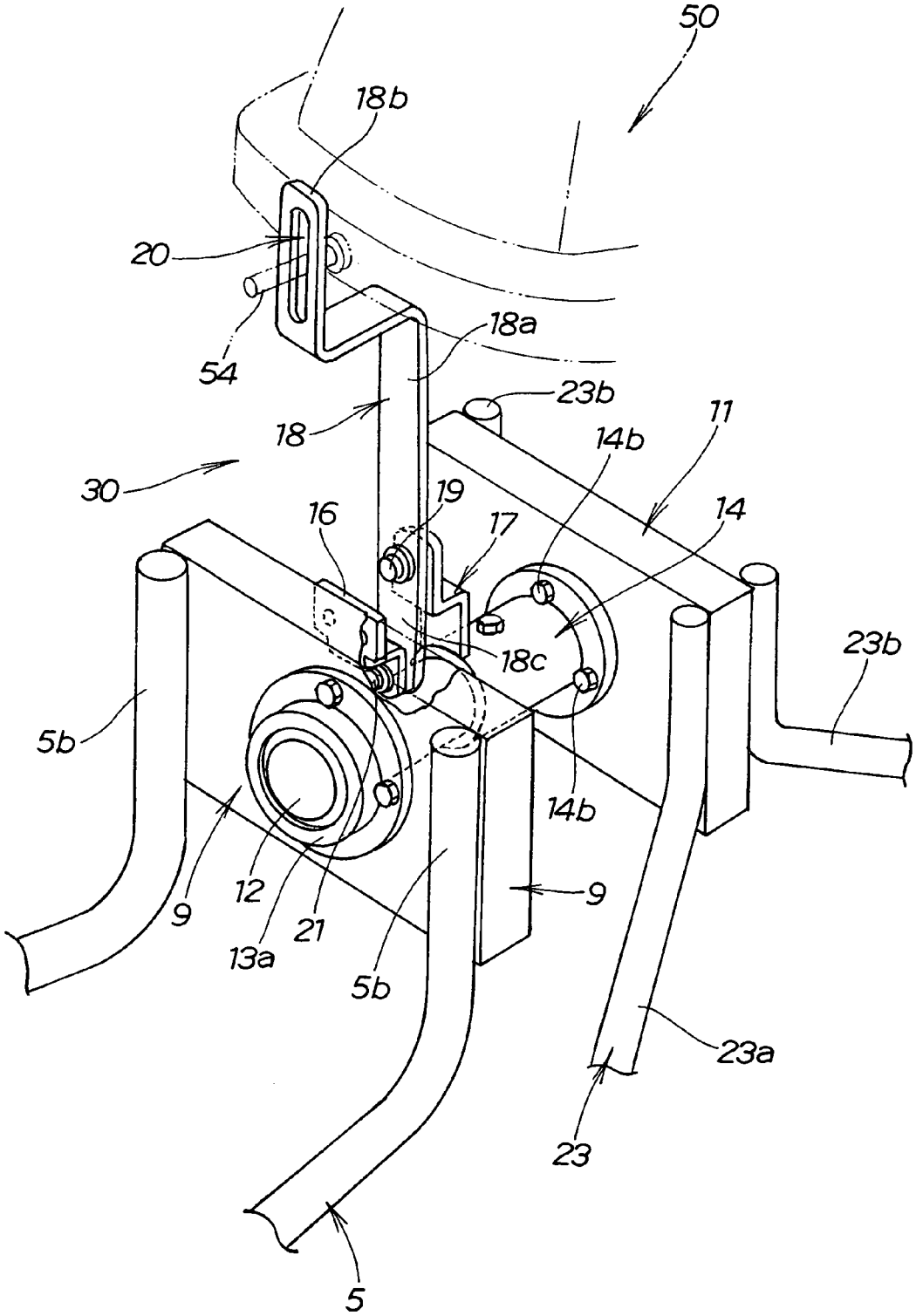
FIG. 18 is a perspective view of the support plate, the mounting portion and the conversion mechanism shown in FIG. 17 in an assembled state.

Next, the structure of a conversion mechanism 30 for converting rotation about a horizontal axis constituted by the rotary shaft 12 rotatably fitted in the support plate 9 into rotation about a vertical axis constituted by the swivel shaft 53 provided at the outboard motor 50 for steering movement of the outboard motor 50, will be described with reference to FIGS. 17, 18 and 19.

Figure 19:
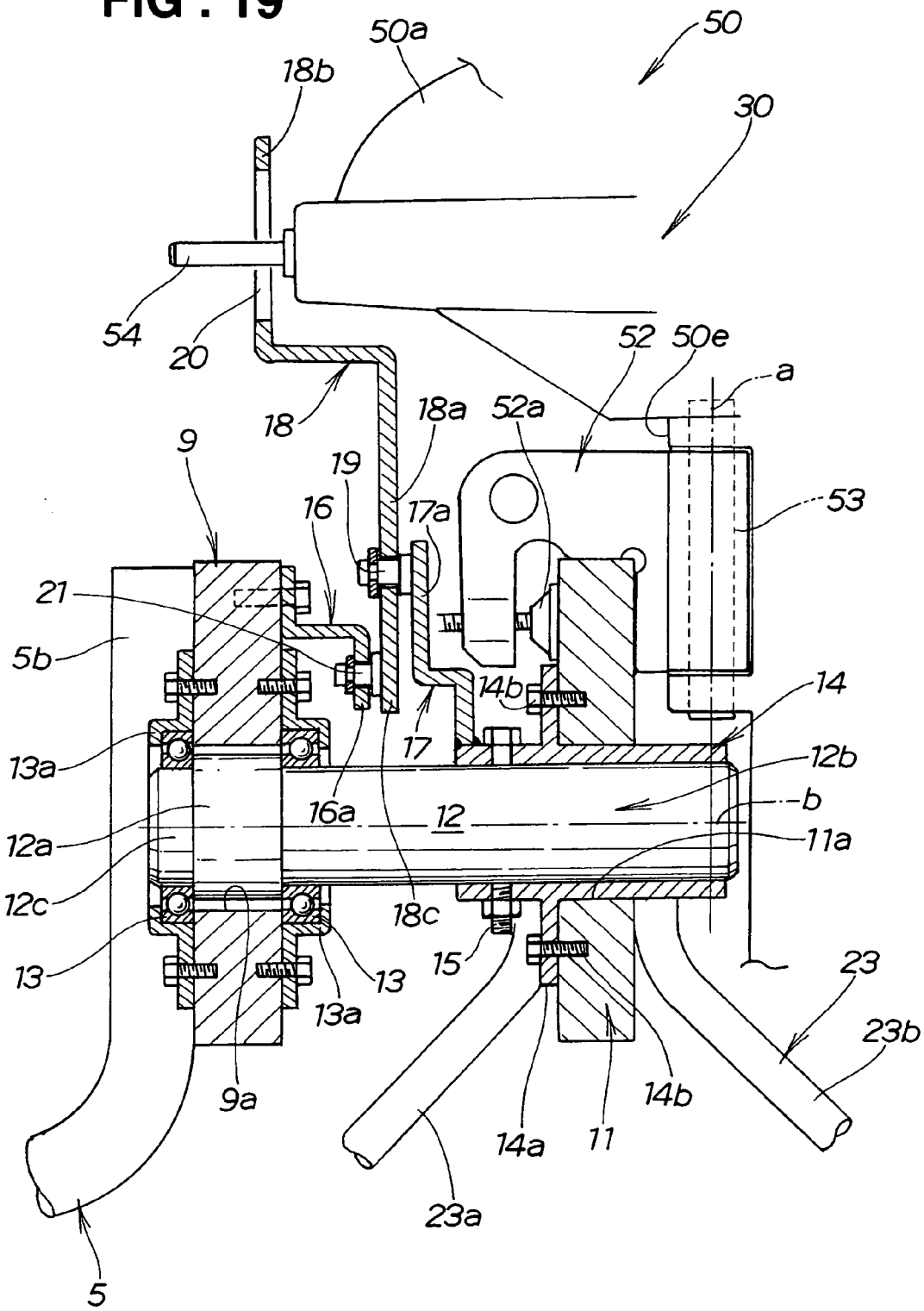
FIG. 19 is a vertical cross-sectional view of FIG. 18.

As shown in FIG. 19, the support plate 9 has a support hole 9*a* formed in a central portion. The support hole 9*a* accommodates a front half portion 12*c* of the rotary shaft 12 oriented longitudinally of the hull 60 (see FIG. 14). Specifically, a large-diameter boss 12*a* at the front half portion 12*c* of the rotary shaft 12 is fitted and located in the support hole 9*a*. Bearings 13, 13 support the front and rear of the large-diameter boss 12*a*, whereby the rotary shaft 12 is rotatably supported by the support plate 9.

The bearings 13, 13 are supported by support fittings 13*a*, 13*a* fixed to the front and rear surfaces of the support plate 9.

A sleeve 14 passes through a central portion of the mounting portion 11. The sleeve 14 is fixed to the mounting portion 11 by screwing a flange 14*a* integrally formed with the sleeve 14 to the front surface of the mounting portion 11 by a plurality of screws 14*b*. A rear half portion 12*b* of the rotary shaft 12 is fitted in the sleeve 14. The sleeve 14 is fixed by a locking through bolt 15 so as not to rotate relative to the rotary shaft 12. Accordingly, the mounting portion 11 is non-rotatable relative to the rotary shaft 12.

The support plate 9 is provided with a first bracket 16 fixed to a surface opposite to the mounting portion 11 by a plurality of screws or the like. The first bracket 16 is substantially Z-shaped in a side view, and is fixed to an upper laterally central portion of the mounting portion 11. That is, the first bracket 16 is fixed to the side of the propulsion machine body 2 (see FIG. 15).

A second bracket 17 opposite to the first bracket 16 is fixed to a front portion of the sleeve 14. The second bracket 17 is substantially Z-shaped in a side view. That is, the second bracket 17 is provided at the side of the outboard motor 50.

A steering link 18 for turning the outboard motor 50 is swingably attached to an upper half portion 17*a* of the second bracket 17 via a pin 19. The steering link 18 is substantially Z-shaped in a side view, and is attached at a middle portion of a lower half portion 18*a* of the link 18 to the second bracket 17 via the pin 19.

The steering link 18 has an upper half portion 18*b* bent forward. A vertically elongated hole 20 is formed in the upper half portion 18*b*. An elongated steering rod pin 54 protruded forward at an upper portion of the outboard motor 50 passes through the elongated hole 20, thereby engaging the steering link 18.

The outboard motor 50 has, in the front part, the swivel shaft 53 passing vertically through the under cover 50*b* and the extension case 50*c* shown in FIG. 14. The stern bracket 52 is rotatably mounted on the swivel shaft 53. With this, the outboard motor 50 swings horizontally about the steering axis a of the swivel shaft 53 via the stern bracket 52, with respect to the mounting portion 11. The swivel shaft 53 forms an axis for turning the outboard motor 50 for steering.

Reference sign b denotes a swinging axis about which the support plate 9 swings with respect to the rotary shaft 12 which is provided horizontally, extending longitudinally of the propulsion machine body 2.

A lower half portion 16*a* of the first bracket 16 is pivotally supported on a pin 21 which is provided at a lower portion 18*c* of the lower half portion 18*a* of the steering link 18 located below the pin 19 which is provided at the lower half portion 18*a*. Thus, the first bracket 16 is connected to the steering link 18 via the pin 21.

With this, when the propulsion machine body 2 swings sideways, the support plate 9 swings sideways about the rotary shaft 12, and also the first bracket 16 swings. The swing of the first bracket 16 causes, via the pin 21, the steering link 18 to swing sideways about the pin 19. That is, the upper half portion 18*b* of the steering link 18 swings sideways about the pin 19. As a result, the steering rod 54 engaging the elongated hole 20 causes, via the swivel shaft 53, the outboard motor 50 to swing horizontally about the steering axis a for steering.

As described above, when the hull 60 (see FIG. 14) tilts sideways, the support plate 9 rotates about the rotary shaft 12. There is provided the conversion mechanism 30 which converts the rotation about the horizontal axis on the rotary shaft 12 into rotation about the vertical axis on the vertical swivel shaft 53 provided at the outboard motor 50. That is, the conversion mechanism 30 automatically converts the rotation into steering movement of the outboard motor 50 with sideways tilting of the hull 60.

As described above, the conversion mechanism 30 is a link mechanism including the first bracket 16 and the steering link 18 connected to the outboard motor 50, for converting rotation about the horizontal axis into rotation about the vertical axis on the swivel shaft 53.

Figure 8:
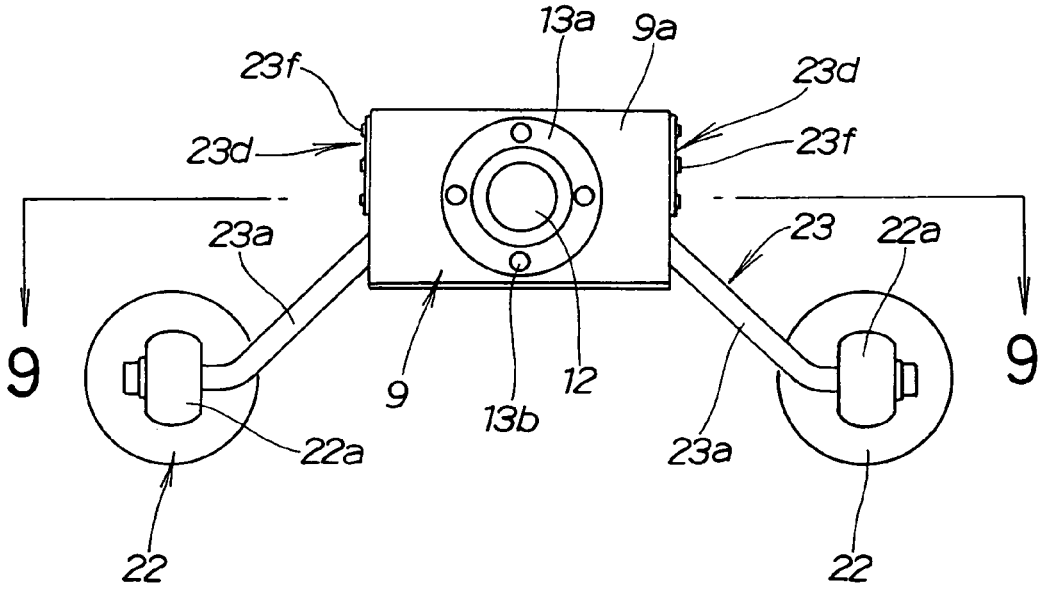
FIG. 8 is a front view of FIG. 6.

The structure for mounting right and left auxiliary buoyant bodies 22, 22 to both sides of the mounting portion 11 is the same as in the first embodiment described with FIGS. 6, 7 and 8, and thus will not be described in detail. In short, the right and left auxiliary buoyant bodies 22, 22 are mounted to right and left side portions of the mounting portion 11 via right and left support stays 23, 23.

Figure 20:
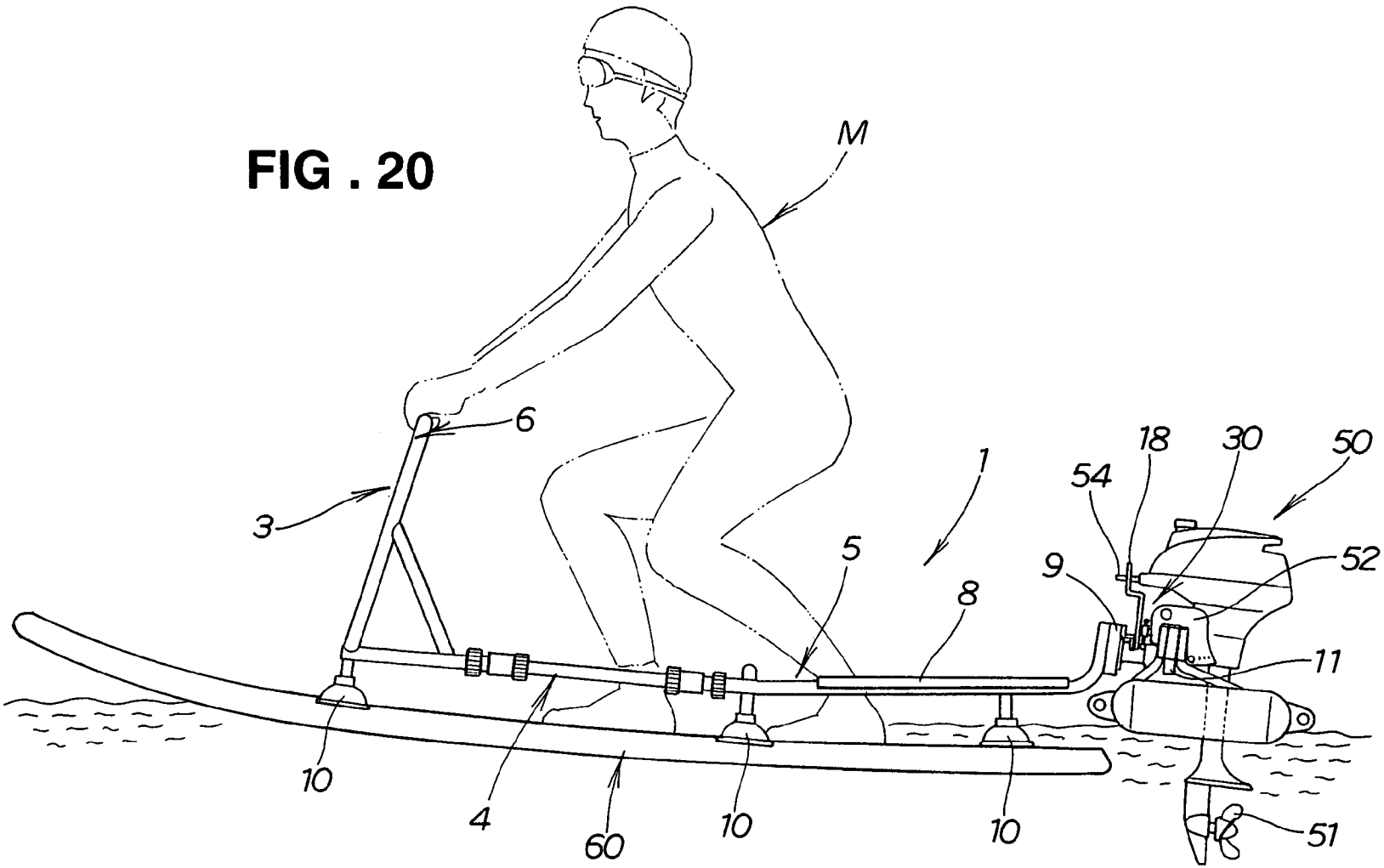
FIG. 20 is a side view illustrating a situation in which a player is riding and steering on a hull to which the propulsion machine is mounted.

FIG. 20 illustrates the propulsion machine 1 mounted on the hull 60. An operator M rides on the hull 60, gripping the handle 6, and propelling the hull 60 by the propulsive power of the outboard motor 50 for sport on the water. The operator M steers the hull 60 by shifting his weight sideways on the hull 60.

Figure 21:
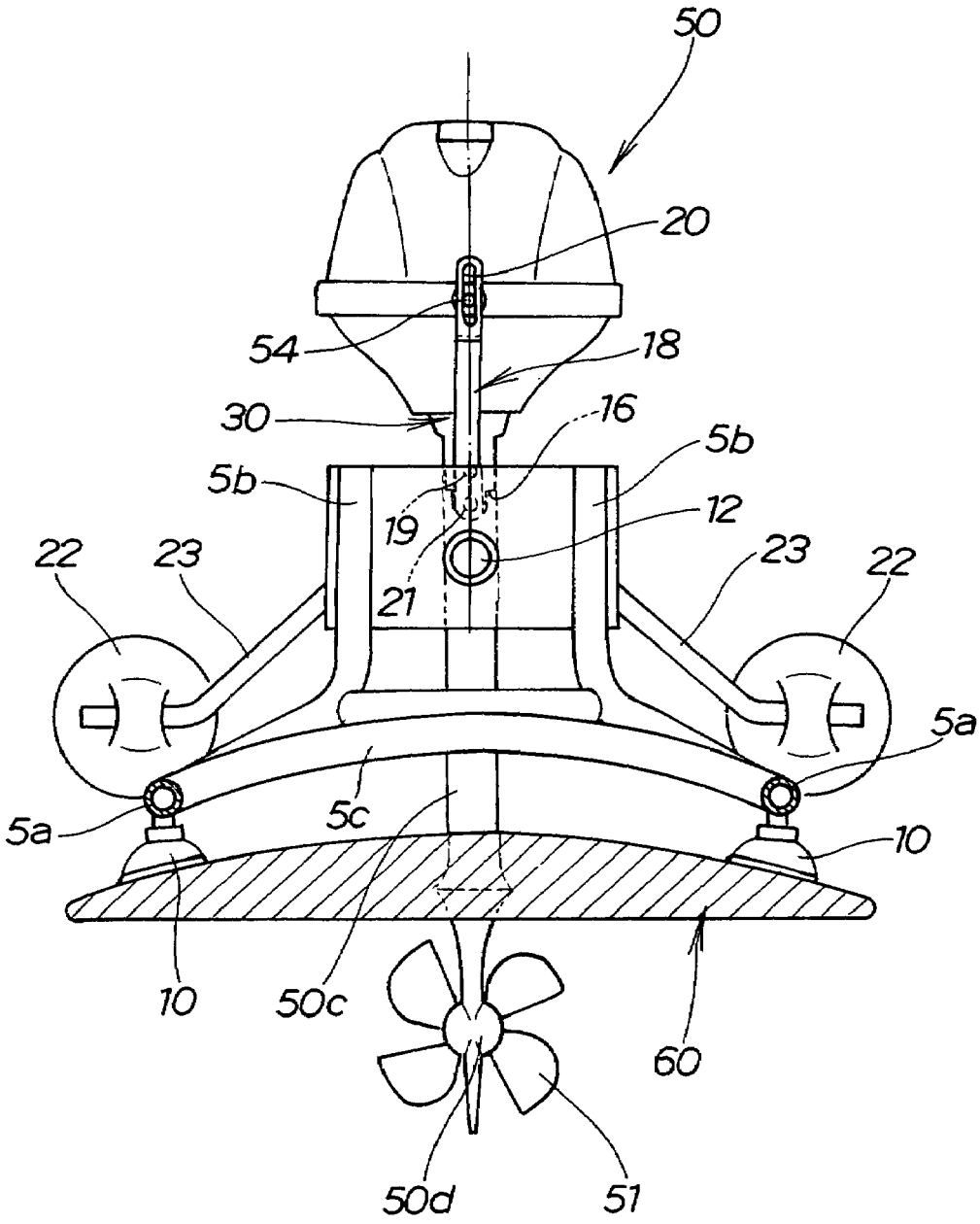
FIG. 21 is a view of the outboard motor when the hull is traveling straight in a horizontal state.
Figure 22:
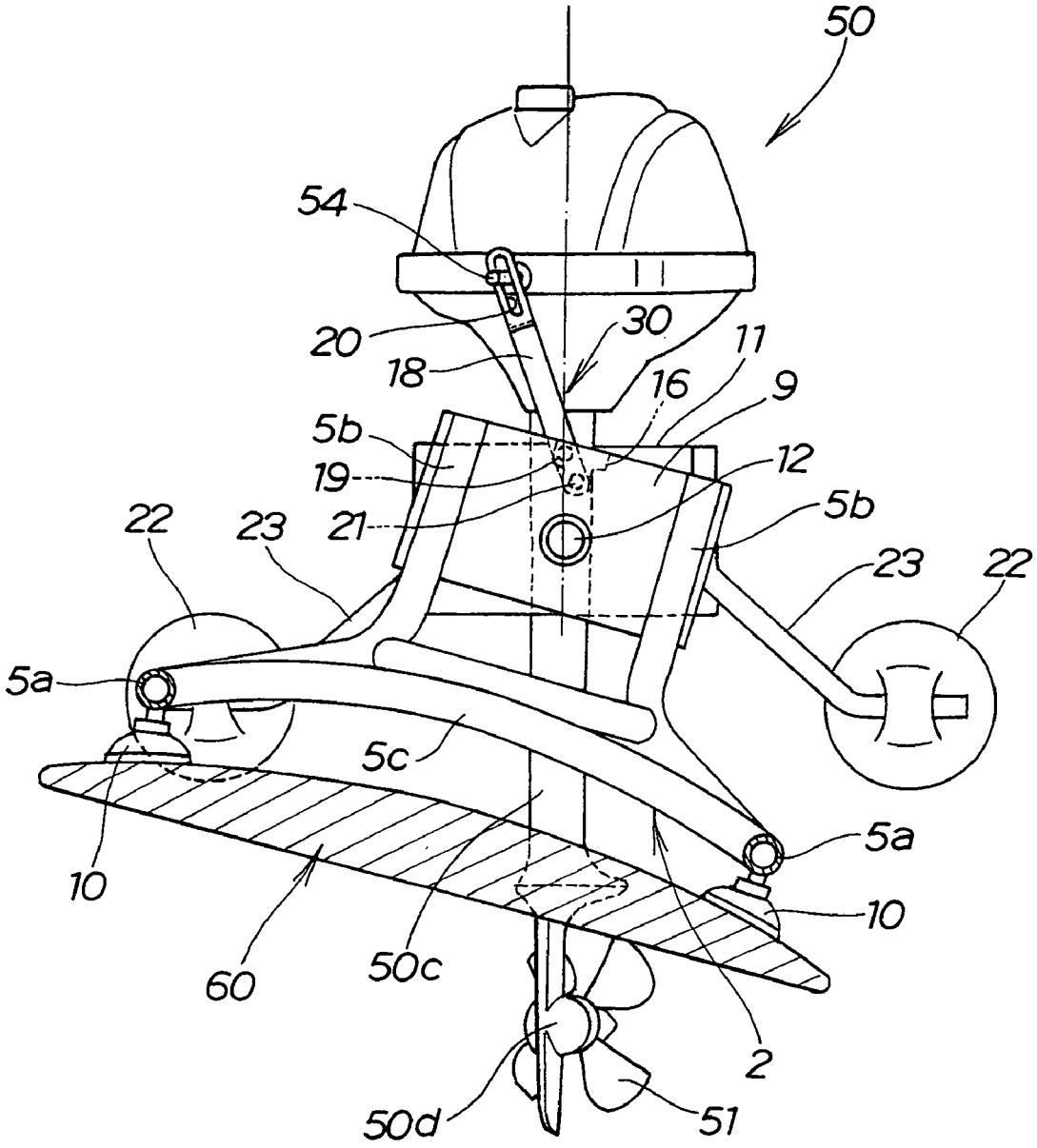
FIG. 22 is a view of a turned state of the outboard motor when the hull tilts to the left from the state in FIG. 21.
Figure 23:
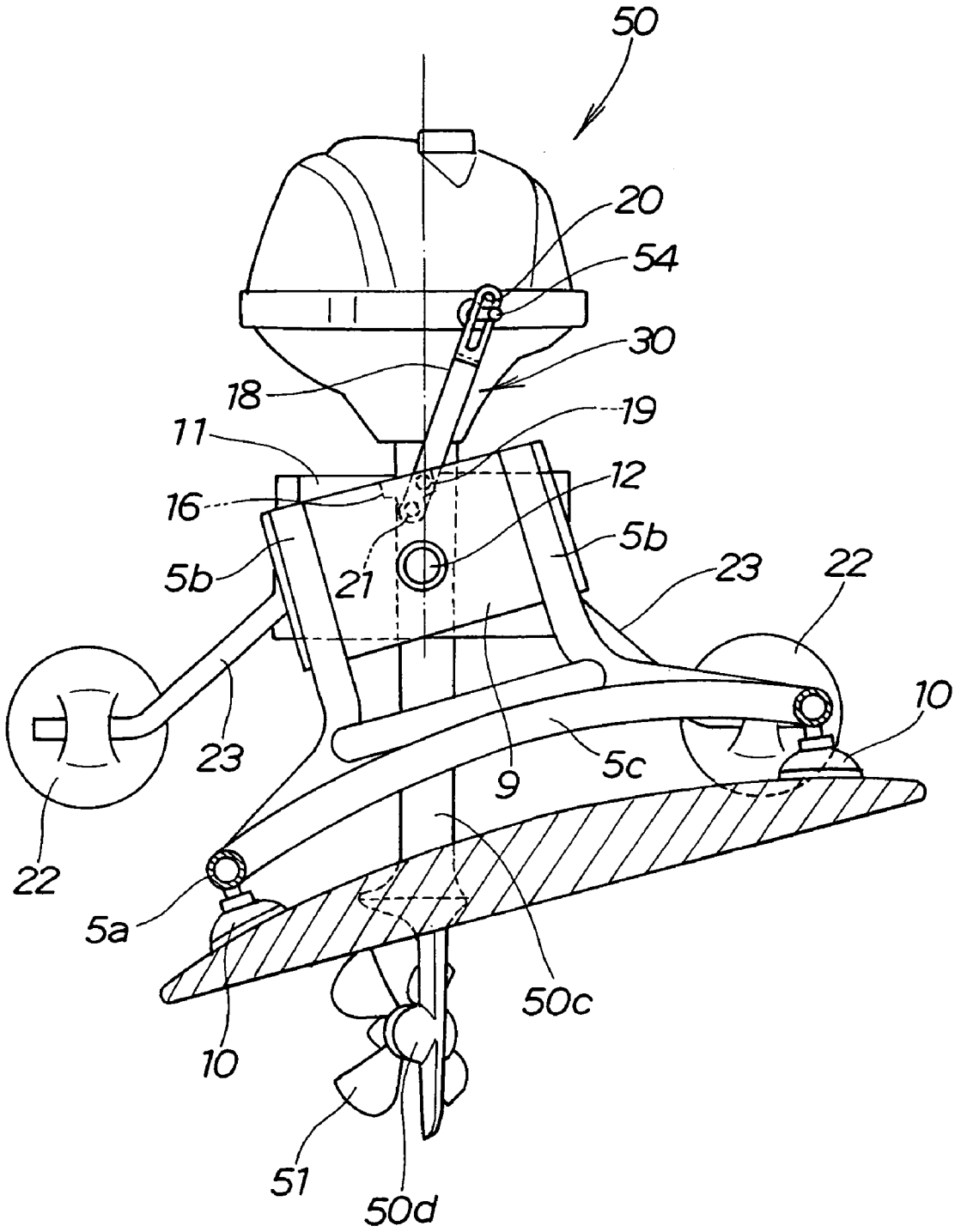
FIG. 23 is a view of a turned state of the outboard motor when the hull tilts to the right from the state in FIG. 21.

FIGS. 21 to 23 illustrate the action of the hull 60 when steered; FIG. 21 illustrates the hull 60 traveling straight in a horizontal position; FIG. 22 illustrates the hull 60 tilted to the left and steered to the left; and FIG. 23 illustrates the hull 60 tilted to the right and steered to the right.

Referring to FIG. 21, the hull 60 is in a horizontal state. The propeller 51 of the outboard motor 50 is oriented directly rearward, and the hull 60 travels straight by the propulsive power of the outboard motor 50.

The operator M (see FIG. 20) shifts his weight on the hull 60 to tilt the hull 60 sideways. At that time, the outboard motor 50 is kept vertically by the action of the auxiliary buoyant bodies 22, 22.

Referring to FIG. 22, when the hull 60 is tilted to the left (to the right in the figure) with respect to the traveling direction of the hull 60 by the operator M shifting his weight, the first bracket 16 provided at the support plate 9 integrated with the propulsion machine body 2, and the pin 21 are tilted in the same direction as the hull 60 is. As a result, the steering link 18 including the pin 21 swings at its upper portion about the pin 19 in the direction opposite to the tilting direction of the hull 60, moving the steering rod 54 of the outboard motor 50 engaging the elongated hole 20 leftward in the figure. With this, the outboard motor 50 is turned in the tilting direction of the hull 60 about the steering axis a via the swivel shaft 53.

Referring to FIG. 23, when the hull 60 is tilted to the right (to the left in the figure) with respect to the traveling direction of the hull 60 by the operator M shifting his weight, the first bracket 16 provided at the support plate 9 integrated with the propulsion machine body 2, and the pin 21 are tilted to the right, in the same direction as the hull 60 is. As a result, the steering link 18 including the pin 21 swings at its upper portion about the pin 19 in the direction opposite to the tilting direction of the hull 60, moving the steering rod 54 of the outboard motor 50 engaging the elongated hole 20 rightward in the figure. With this, the outboard motor 50 is turned in the tilting direction of the hull 60 about the steering axis a via the swivel shaft 53.

As described above in the second embodiment, for steering the hull 60, the hull 60 is tilted sideways by an operator's weight shift to turn the outboard motor 50 in a tilting direction of the hull 60 via the conversion mechanism 30. With this, the watercraft can be steered with a sense of steerage the craft originally has.

A propulsion machine according to the present invention is applied to a surfboard in the embodiments by way of example. It may also be applied to a small watercraft without a propulsion unit, such as a windsurfing board, a rowboat or something else.

Although, in the above-described embodiments, suction cups are used as a detachable mounting mechanism, the mounting mechanism detachably mounted to a hull is not limited thereto. Depending on the shape of a watercraft, mounting mechanisms other than suction cups can be adopted. For example, for a windsurfing board with a removable sail and mast, an existing male and female mounting mechanism can be used, using mounting fixtures at the other side, and the mounting mechanism is not limited to the suction cups.

In the embodiments, an outboard motor is used as a propulsion unit. The outboard motor can be replaced with a water-jet pump.

Obviously, various minor changes and modifications of the present invention are possible in the light of the above teaching. It is therefore to be understood that within the scope of the appended claims the invention may be practiced otherwise than as specifically described.

What is claimed is:

1. A propulsion machine detchably mountable to a watercraft, comprising:

a propulsion machine body detachably mountable to the watercraft via a mounting mechanism; and a propulsion unit swingably connected to the propulsion machine body via a shaft oriented longitudinally of the propulsion machine body and pivotally movable about an axis of the shaft relative to the propulsion machine body to maintain a vertical operating position when the propulsion machine body mounted on the watercraft rolls about the axis of the shaft together with the watercraft.

2. A propulsion machine detachably mountable to a watercraft, comprising:

a propulsion machine body detachably mountable to the watercraft via a mounting mechanism;

a propulsion unit swingably connected to the propulsion machine body via a shaft oriented longitudinally of the propulsion machine body; and a pair of right and left auxiliary buoyant bodies, the auxiliary buoyant bodies being swingably connected to the propulsion machine body via the shaft oriented longitudinally of the body.

3. A propulsion machine detachably mountable to a watercraft, comprising:

a propulsion machine body detachably mountable to the watercraft via a mounting mechanism;

a propulsion unit swingably connected to the propulsion machine boby via a horizontal shaft oriented longitudinally of the propulsion machine body, the propulsion unit being provided in a steerable manner on a vertical shaft;

a mounting portion mounted on the longitudinally-oriented horizontal shaft, to which the propulsion unit is mounted; and a conversion mechanism for converting rotation about the longitudinally-oriented horizontal shaft into rotation about the vertical shaft when the watercraft tilts sideways, so that the propulsion unit is moved for steering with the tilting.

4. A propulsion machine as set forth in claim 3, wherein:

the conversion mechanism comprises a first bracket fixed at the propulsion machine body side, and a swingable steering link pivotally supported at a middle portion thereof on the mounting portion;

an upper portion of the steering link is connected to a steering rod protruded forward from the propulsion unit in such a manner as to restrict a relative displacement in a swinging direction of the steering link and allow a relative displacement in a longitudinal direction of the steering link; and the first bracket and a portion below the pivotally supported portion of the steering link are swingably connected.

5. A propulsion machine as set forth in claim 3, wherein the mounting portion is provided with auxiliary buoyant bodies at right and left sides thereof.

6. A propulsion machine as set forth in claim 4, wherein:

the steering link includes an elongated hole formed in the upper portion thereof and extending longitudinally; and the steering rod is connected to the upper portion of the steering link to be movable along the elongated hole.

7. A propulsion machine according to claim 1, wherein the propulsion machine body includes a mounting portion connected to the shaft for rotation therewith, and the propulsion unit includes a stern bracket secured to the mounting portion.

8. A propulsion machine according to claim 7, wherein the mounting portion comprises a plate member.

* * * * *